US007791260B2

(12) United States Patent
Gallimore et al.

(10) Patent No.: US 7,791,260 B2
(45) Date of Patent: Sep. 7, 2010

(54) GAS-FED HOLLOW CATHODE KEEPER AND METHOD OF OPERATING SAME

(75) Inventors: Alec Gallimore, Ann Arbor, MI (US); Joshua Rovey, Champaign, IL (US)

(73) Assignee: The Regents of The University of Michigan, Ann Arbor, MI (US)

( * ) Notice: Subject to any disclaimer, the term of this patent is extended or adjusted under 35 U.S.C. 154(b) by 585 days.

(21) Appl. No.: 11/828,917

(22) Filed: Jul. 26, 2007

(65) Prior Publication Data

US 2008/0047256 A1 Feb. 28, 2008

Related U.S. Application Data

(60) Provisional application No. 60/820,374, filed on Jul. 26, 2006.

(51) Int. Cl.
*F03H 1/00* (2006.01)

(52) U.S. Cl. ..... 313/359.1; 313/360.1; 60/202; 315/81

(58) Field of Classification Search ..... 315/111.91, 315/111.81, 111.21; 313/359.1, 360.1; 60/202, 60/204

See application file for complete search history.

(56) References Cited

U.S. PATENT DOCUMENTS

| | | | | |
|---|---|---|---|---|
| 5,924,277 | A * | 7/1999 | Beattie et al. | 313/360.1 |
| 6,195,980 | B1 * | 3/2001 | Walther | 60/202 |
| 6,336,318 | B1 * | 1/2002 | Falce et al. | 315/111.81 |
| 6,729,174 | B1 * | 5/2004 | Patterson et al. | 73/1.01 |
| 2006/0132017 | A1 * | 6/2006 | Kaufman et al. | 313/339 |

* cited by examiner

*Primary Examiner*—Douglas W Owens
*Assistant Examiner*—Ephrem Alemu
(74) *Attorney, Agent, or Firm*—Harness, Dickey & Pierce, P.L.C.

(57) ABSTRACT

A gas-fed hollow cathode keeper can reduce ion bombardment erosion by expelling gas through the keeper faceplate. The expelled gas effectively creates a high-pressure "shield" around the keeper such that bombarding ions suffer energy-reducing collisions before impacting the keeper. If the bombarding ion energy is reduced enough, the erosion is eliminated since sputtering is a threshold phenomenon.

20 Claims, 21 Drawing Sheets

GAS-FED HOLLOW CATHODE KEEPER AND METHOD OF OPERATING SAME

CROSS-REFERENCE TO RELATED APPLICATION

This application claims the benefit of U.S. Provisional Application No. 60/820,374, filed on Jul. 26, 2006. The disclosure of the above application is incorporated herein by reference.

FIELD

The present teachings relate to ion thrusters and, more particularly, to a gas-fed hollow cathode keeper and method of operating same.

BACKGROUND AND SUMMARY

The statements in this section merely provide background information related to the present teachings and may not constitute prior art.

Ion thrusters are high-efficiency, high-specific impulse, advanced-electric space propulsion systems that are being proposed for ambitious deep-space missions that can require thruster operational lifetimes measured in years. For example, the goal of NASA's Project Prometheus is to advance the future of space exploration by developing Nuclear Electric Propulsion (NEP) technology for deep space missions. Ion thrusters are proposed as the primary propulsion source for such missions and to satisfy the mission requirements must have long life, high-power and high-specific impulse. In these applications, ion thrusters may be required to operate continuously for perhaps as long as 7-14 years.

Commercially available ion thrusters designed for station-keeping and orbit-raising applications can also require extended lifetimes. For example, Aerojet and L3 Communications are designing and developing ion thrusters for integration onto satellites for orbit-raising and station-keeping applications. These ion thrusters have a similar design to NASA thrusters and have the same lifetime limitations and potential failure mechanisms.

One of the primary components of an ion thruster is the discharge cathode assembly (DCA). The DCA can include a hollow cathode with a surrounding keeper and is responsible for initiating and sustaining ion thruster operation. Unfortunately, wear-test and extended-life test results of a 30-cm ion thruster show that a molybdenum (Mo) keeper DCA can last only 3 years due to ion bombardment erosion. Therefore, contemporary Mo keeper DCAs utilized in ion thrusters are incapable of satisfying the 7-14 year mission requirement.

A gas-fed hollow cathode keeper according to the present teachings can reduce ion bombardment erosion by expelling gas through the keeper faceplate. The expelled gas effectively creates a high-pressure "shield" around the keeper such that bombarding ions suffer energy-reducing collisions before impacting the keeper. If the bombarding ion energy is reduced enough, the erosion is eliminated since sputtering is a threshold phenomenon.

Further areas of applicability will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present disclosure in any way.

DETAILED DESCRIPTION

Figure 1:
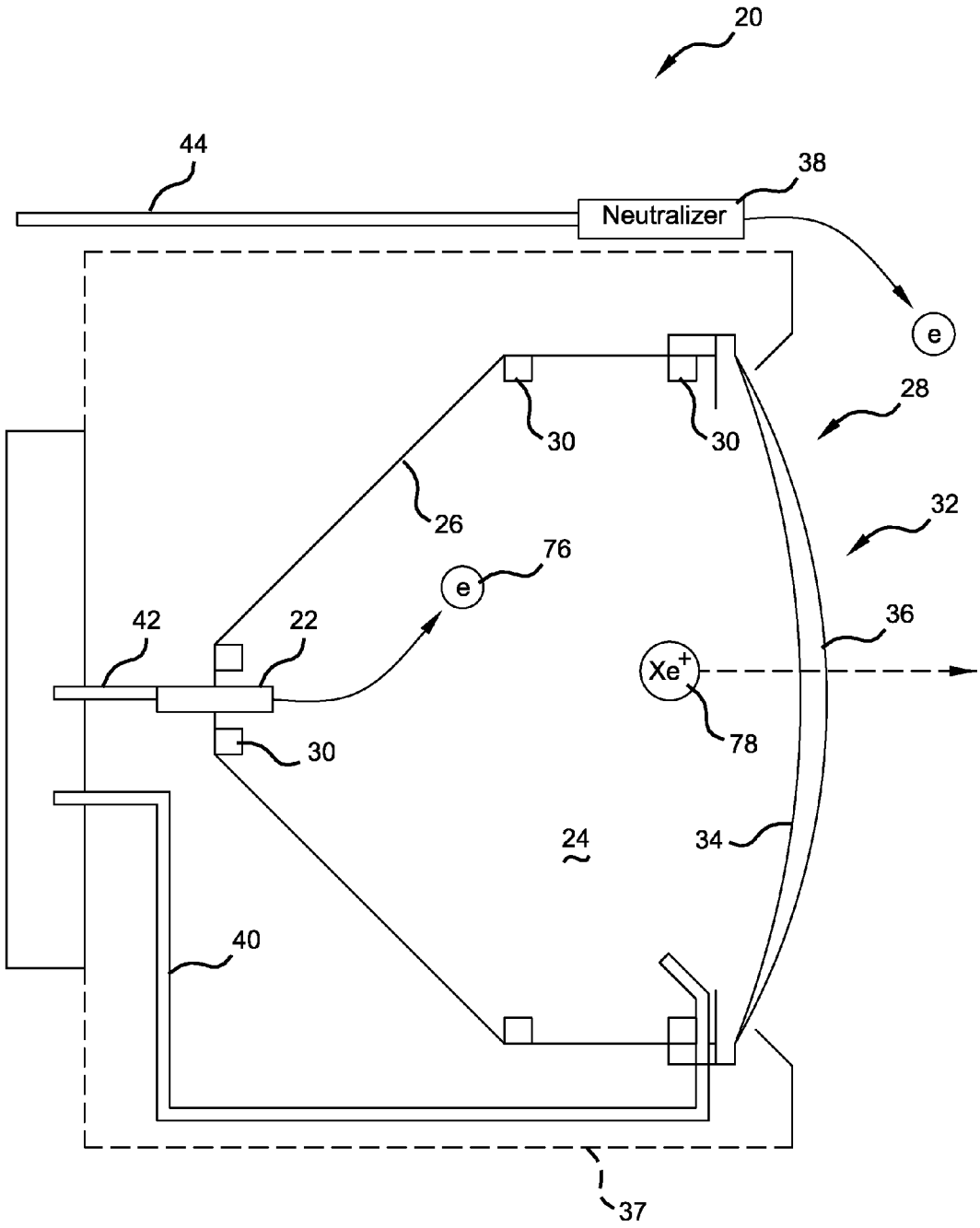
FIG. 1 is a schematic illustration of a typical ion thruster.

The following description is merely exemplary in nature and is not intended to limit the present teachings, application, or uses. It should be understood that throughout the drawings, corresponding reference numerals indicate like or corresponding parts and features (e.g., 20, 120, 220, etc.).

A typical ion thruster 20 is schematically illustrated in FIGS. 1-3 and 5. Ion thruster 20 includes a cathode 22 which is operable to generate electrons that are discharged into a discharge chamber 24. Discharge chamber 24 includes a discharge chamber wall 26 and an opening 28 through which ions are discharged. Discharge chamber wall 26 acts as the anode for ion thruster 20. A plurality of magnets 30 can extend around discharge chamber 24. Discharge chamber 24 typically has a cylindrical-conical shape (as shown) or a cylindrical shape. An extraction grid (ion optics) 32 extends across opening 28 of discharge chamber 24. Extraction grid 32 can be a two-grid system with a screen grid 34 and an accelerator grid 36. Grids 34, 36 can be spaced from less than a millimeter to a few millimeters apart, and can have potential differences ranging from a few hundred volts to over 5000 V. These values are dictated by the required thrust, specific impulse, thruster operating condition, size, and power-rating. A plasma screen 37 can extend around discharge chamber 24 and cathode 22. The plasma screen 37 isolates the high-voltage ion thruster discharge chamber 24 from the low-voltage plasma surrounding the ion thruster 20 in space or in a vacuum chamber on the ground.

A neutralizer 38 can be disposed outside of discharge chamber 24 and plasma screen 37. The neutralizer 38 is similar to the cathode 22 and is operable to emit electrons into the ion beam exiting discharge chamber 24. The purpose of the neutralizer 38 is to inject an electron beam of current equal to the ion beam extracted through the ion optics 32 in order to prevent the ion thruster 20 from accumulating excess charge. A propellant feed line 40 supplies gas propellant to the discharge chamber 24. Another propellant feed line 42 supplies propellant to the cathode 22. Another propellant feed line 44 supplies propellant to the neutralizer 38. The gas propellant can include a noble gas, such as xenon. Propellant feed lines 40, 42, 44 can all be supplied from a common propellant source (not shown). Flow control devices (not shown) control the quantity of propellant supplied to discharge chamber 24, cathode 22, and neutralizer 38 through the respective feed lines 40, 42, 44, to obtain the desired operation of ion thruster 20.

Figure 4:
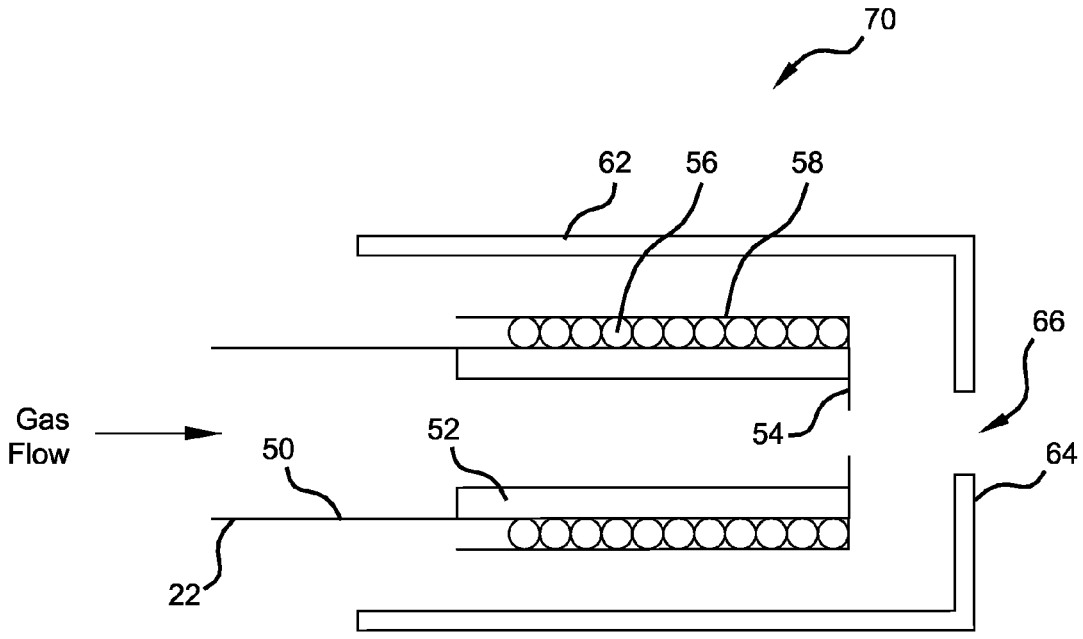
FIG. 4 is a schematic representation of a typical prior art discharge cathode assembly used in an ion thruster.
Figure 5:
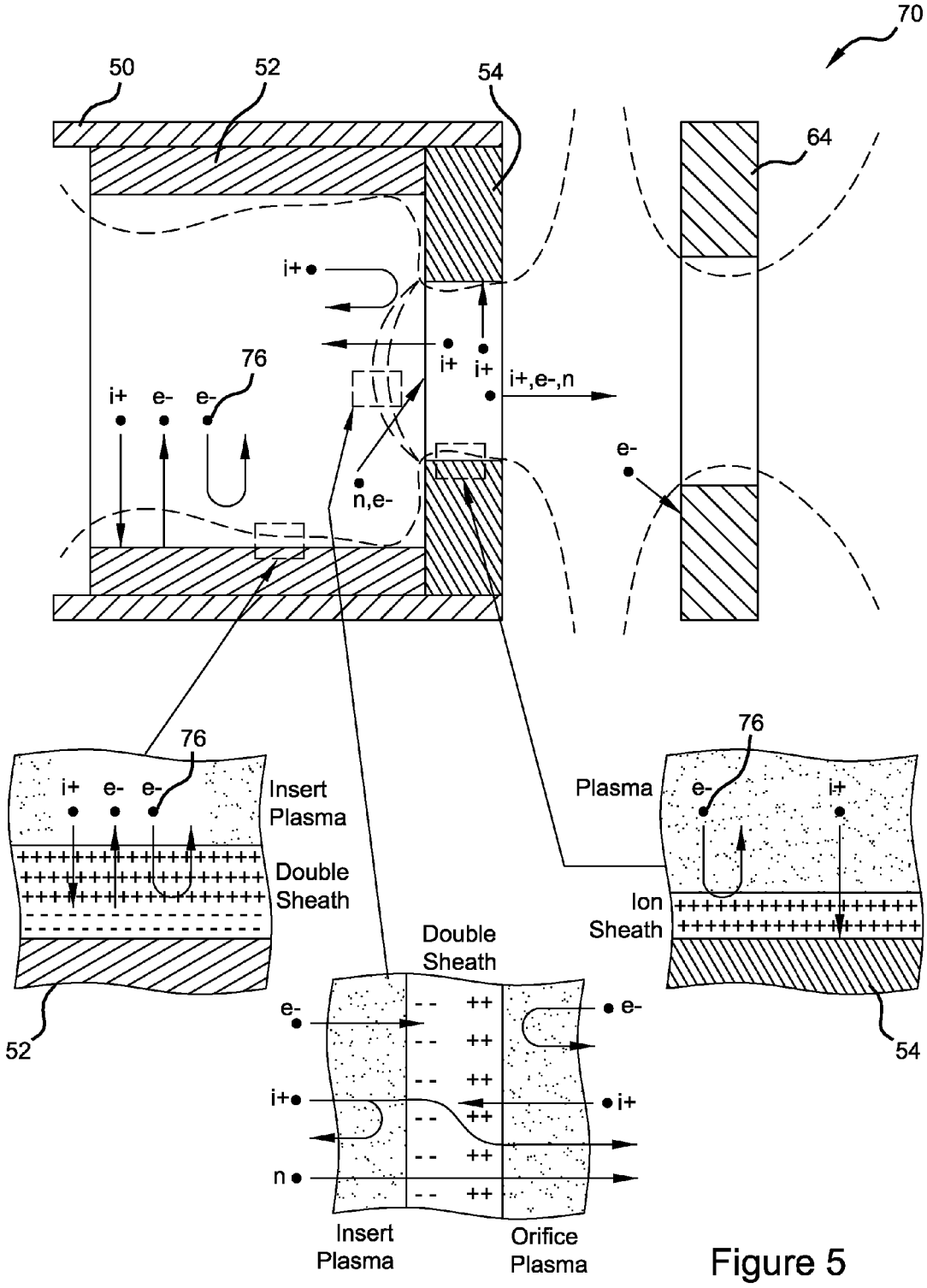
FIG. 5 is a schematic illustration of the physics of the discharge cathode assembly of FIG. 4.

Referring to FIGS. 4 and 5, details of the cathode 22 are shown. The cathode 22 is used to generate electrons. The cathode 22 can include a hollow cathode tube 50 with an insert 52 therein. An orifice plate 54 with an opening therein can be disposed on an end of cathode tube 50 adjacent insert 52. Propellant and electrons exit cathode tube 50 through orifice plate 54. A heater coil 56 can surround the exterior of cathode tube 50 in the area associated with insert 52. A radiation shield 58 can extend around heater coil 56.

A keeper 60 extends around cathode 22 and can assist in cathode ignition and can protect cathode 22 from external ion bombardment. Keeper 60 can include a tube portion 62 which can be concentric with cathode tube 50. Keeper 60 includes a keeper faceplate 64 with a central orifice 66 therein. Central orifice 66 can be generally aligned with the central orifice of orifice plate 54 to allow electrons and propellant discharged from orifice plate 54 of cathode tube 50 to exit keeper 60 and travel into discharge chamber 24. Cathode 22 and surrounding keeper 60 form a discharge cathode assembly (DCA) 70.

Cathode tube 50 can be made from a variety of materials. For example, cathode tube 50 can be made of molybdenum, tungsten, and tantalum, by way of non-limiting example. These materials are capable of withstanding high temperatures and are conductive. Insert 52 discharges electrons and can be made of a variety of materials. For example, insert 52 can be barium-impregnated tungsten, lanthanum hexaboride, and barium-oxide, by way of non-limiting example. Keeper 60 can be made from a variety of materials. For example, keeper 60 can be made of molybdenum and carbon, such as graphite, by way of non-limiting example. Heater coil 56 can be made from tantalum, by way of non-limiting example. Radiation shield 58 can be made from tantalum foil, by way of non-limiting example. It should be appreciated that the materials described above are merely exemplary in nature and are not all inclusive and that different materials can be utilized without departing from the spirit and scope of the present teachings.

Neutralizer 38 is similar to DCA 70 and can include a cathode tube with an insert, an orifice plate, a heater coil, a radiation shield, and a keeper 72. Neutralizer 38 can be made of the same materials as DCA 70.

Figure 3:
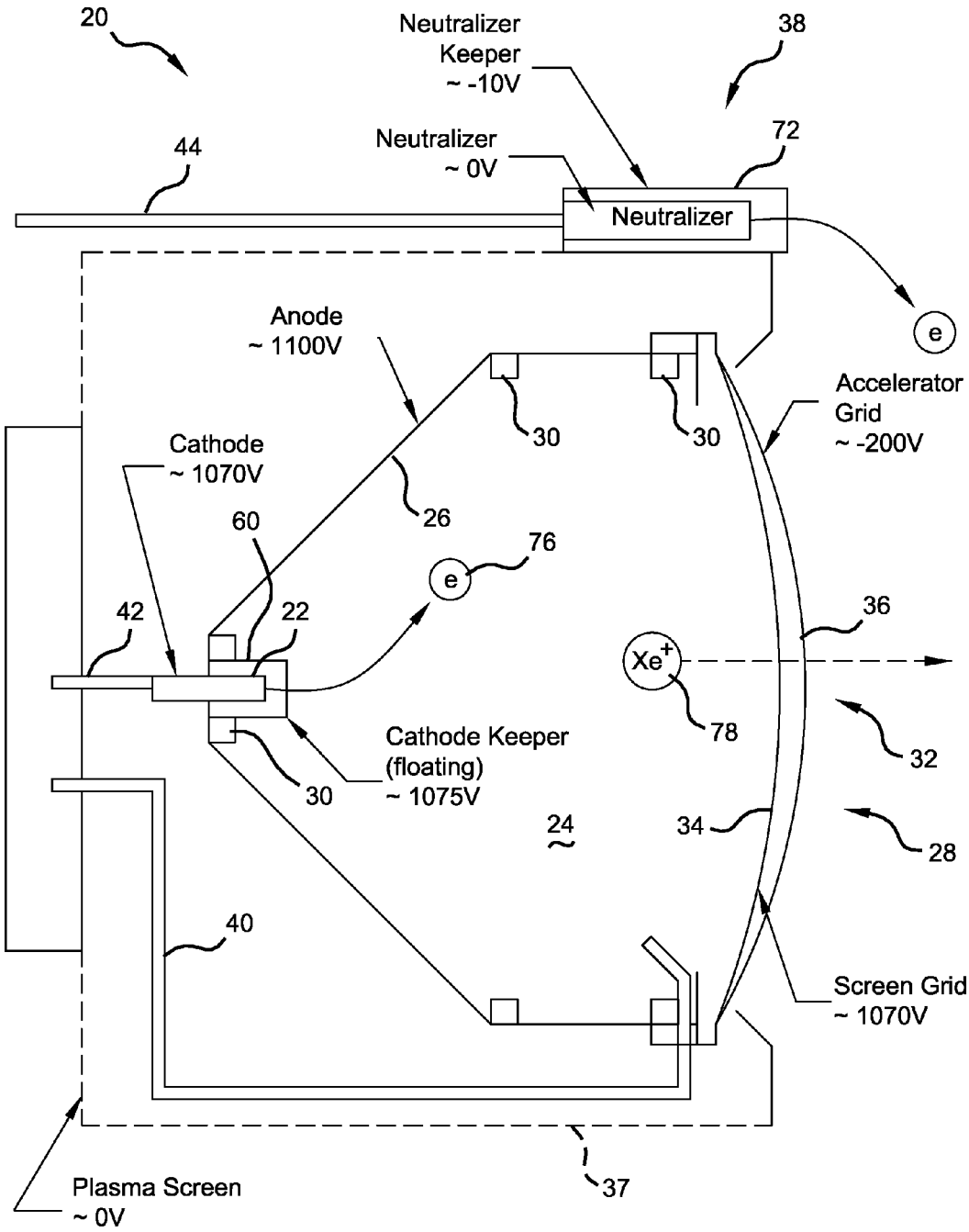
FIG. 3 is a schematic illustration of the ion thruster of FIG. 1 showing possible electrical potentials of the various components.

Referring now to FIG. 3, the components of ion thruster 20 can be maintained at different electrical potentials to facilitate operation. The following voltage potentials are made with respect to the voltage of neutralizer 38, which can be at ≈0 V. Cathode 22 can be at ≈1070 V, keeper 60 at ≈1075 V, discharge chamber wall 26 (the anode) at ≈1100 V, screen grid 34 at ≈1070 V, accelerator grid 36 at ≈−200 V, neutralizer keeper 72 at ≈10 V, and plasma screen 37 at ≈0 V. It should be appreciated that these voltage potentials are provided merely for exemplary purposes and that other voltage potentials can exist.

Ion thruster 20 operation can be divided into three main processes or stages. The first stage is the generation of electrons 76. Next, electrons 76 collide with neutral propellant atoms 80, such as Xenon, to generate an ionized gas called plasma. This type of plasma generation is called electron-bombardment ionization. Finally, the third stage extracts the positively-charged ions 78 with an electric field.

The first stage of ion thruster 20 operation requires the generation of electrons 76 and is accomplished with cathode 22 of DCA 70. Cathode 22 is ignited by first supplying a current to the heater coil 56, which heats the insert 52 to approximately 1000° C. Next, propellant gas flow is supplied to cathode 22 through feed line 42 while a potential is applied between the cathode 22 and an external anode (typically discharge chamber wall 26). This combination of heat and voltage causes electrons 76 to be thermionically emitted from the insert 52 and then interact with the propellant gas flow, creating plasma inside the cathode tube 50. At this point, the cathode 22 becomes self-sustaining and the heater current is eliminated because plasma ions 78 recombine at the insert 52, depositing their energy and sustaining the cathode-insert temperature required for electron emission, as illustrated in FIG. 5. Electrons 76 are pulled through the opening in cathode orifice plate 54 and orifice 66 in faceplate 64 by the potential between the cathode and anode, and emitted electrons 76 enter the discharge chamber 24. Keeper 60 around the cathode 22 assists cathode ignition and protects the cathode 22 from external ion bombardment.

During the second stage of ion thruster 20 operation, the electrons 76 emitted from the cathode 22 collide with neutral propellant atoms 80 to create an ionized gas called plasma. This process occurs within the discharge chamber 24 of the ion thruster 20. Emitted electrons 76 leave the cathode 22 and accelerate toward the anode potential surface, which is typically the discharge chamber wall 26. As electrons 76 move toward the anode, they suffer collisions with neutral propellant atoms 80 and some of these collisions result in the ionization of the neutral atoms. An ionizing collision causes the neutral atom 80 to lose an electron and become an ion 78.

The last stage of ion thruster 20 operation is the acceleration and expulsion of ions 78 from the discharge chamber 24 to generate thrust. Ions 78 created within the discharge chamber 24 preferentially drift to the extraction grids 32 (the ion optics) at the ion-acoustic or Bohm velocity. The screen grid 34 is on the discharge-chamber side of the ion optics 32 and is maintained at cathode potential. As ions 78 reach the screen grid 34, they are accelerated out of the accelerating grid 36 to very high velocity (e.g., 30 km/s or 67,000 miles-per-hour). In order to obtain such high ion exhaust velocities, the entire discharge chamber 24 and cathode 22 surfaces must be biased over 1000 V above spacecraft ground potential.

Figure 2:
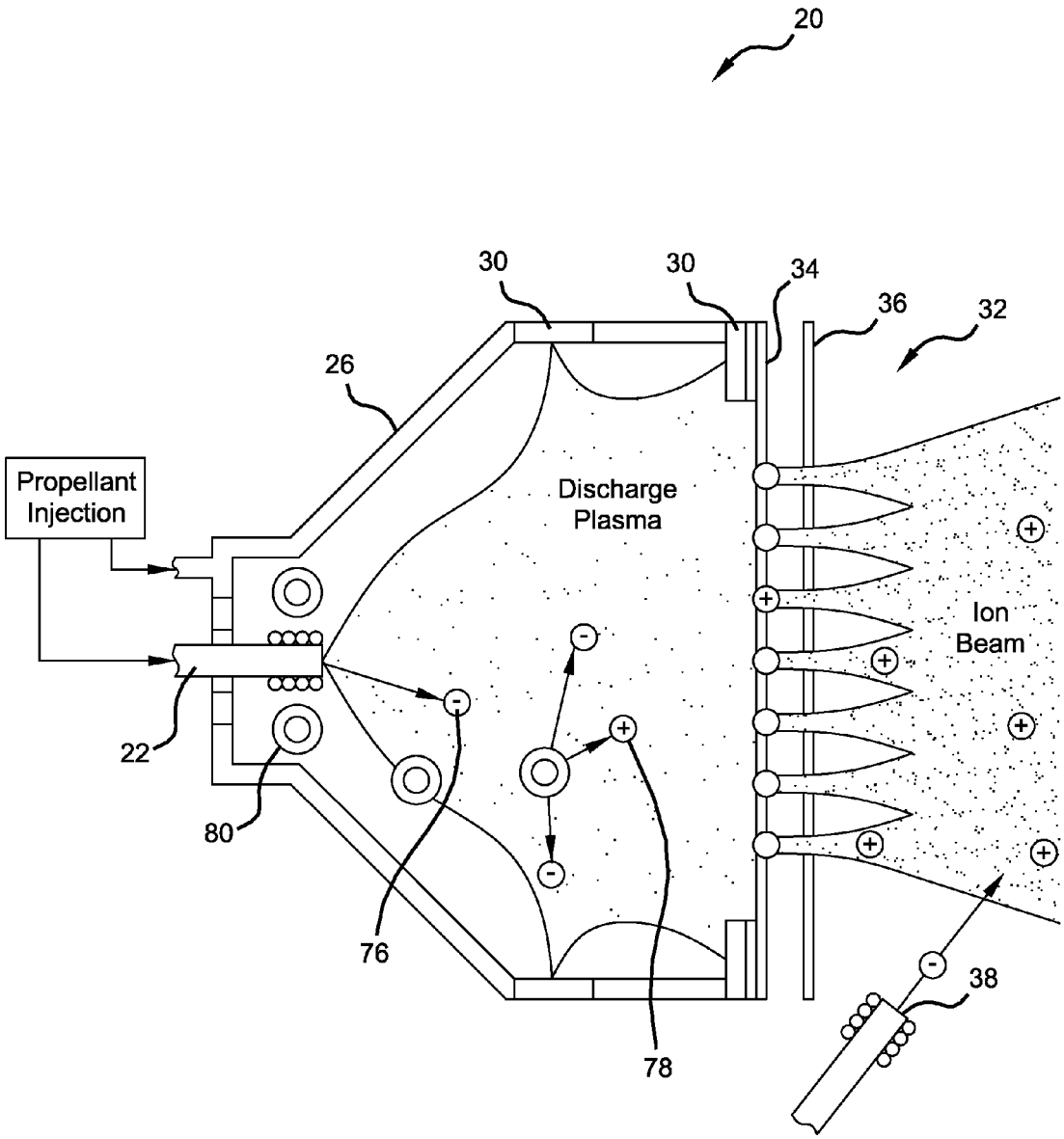
FIG. 2 is a schematic illustration of the operation of the ion thruster of FIG. 1.

To prevent space-charge build-up of the ion thruster 20 and spacecraft, the high-velocity ion exhaust beam is neutralized using the neutralizer 38 (shown in FIGS. 1-3). The neutralizer 38 is external to thruster 20 and emits electrons 82 into the ion beam. Without this device, a spacecraft obtains a net negative charge due to the loss of positive charge through the ion beam. Ion thruster 20 operation without a neutralizer 38 can cause beam ions to reverse direction and impinge upon the spacecraft. To keep neutralizer-emitted electrons from backstreaming and entering the thruster discharge chamber 24, the accelerator grid 36 is biased a few hundred volts below spacecraft ground potential.

The potential failure mechanisms for ion thrusters 20 are generally classified into four categories: (1) discharge cathode assembly (DCA) 70 failure; (2) neutralizer 38 failure; (3) ion optics 32 failure; and (4) electron backstreaming. Erosion of the screen and accelerator grids 34, 36 due to ion 78 impingement is the primary cause of failure mode 3. As the accelerator grid 36 apertures widen due to erosion, mode 4 becomes important because the number of backstreaming electrons 76 increases and eventually destroys the cathode 22. Methods for increasing accelerator grid 36 lifetime and reducing electron backstreaming have been developed. Failure of the DCA 70 and neutralizer 38 is the primary cause of modes 1 and 2. DCA 70 and neutralizer 38 failure is known to be caused by either depletion of the barium insert 52, the formation of tungstates in the barium, or physical erosion. Physical erosion of both the DCA 70 and ion optics 32 is the primary lifetime-limiting, ion-thruster phenomena.

Erosion of the cathode 22 and/or the DCA 70 has been noted in three wear tests performed on a 30-cm ion thruster and an extended life test (ELT) on the flight spare Deep Space One NASA Solar Electric Propulsion Technology and Applications Readiness (NSTAR) ion engine. During the first wear test, erosion of the discharge cathode was noted (during this test the DCA did not have a keeper), and the engineering solution was to utilize a sacrificial molybdenum (Mo) keeper maintained at an intermediate potential between the discharge cathode and anode. The subsequent 1,000-hr and 8,200-hr wear tests showed erosion of the DCA keeper occurring primarily from the downstream keeper face. However, during the ELT, the primary erosion location changed from the keeper downstream face to the keeper orifice. Consequently, the lifetime of the NSTAR ion thruster is limited to ~30,000 hours and recent results indicate the NASA Evolutionary Xenon Thruster (NEXT) may have a comparable lifetime. It is important to note that contemporary ion thruster technology utilizing Mo DCA keepers is incapable of providing Prometheus-class mission lifetimes due to discharge cathode erosion, which limits the operational life to approximately 3 years.

Applicants have ascertained the erosion process that occurs in the components of DCA 70. In the interest of brevity, the erosion process is discussed briefly immediately below. A more detailed discussion of the erosion process is provided toward the end of this section.

Figure 6:
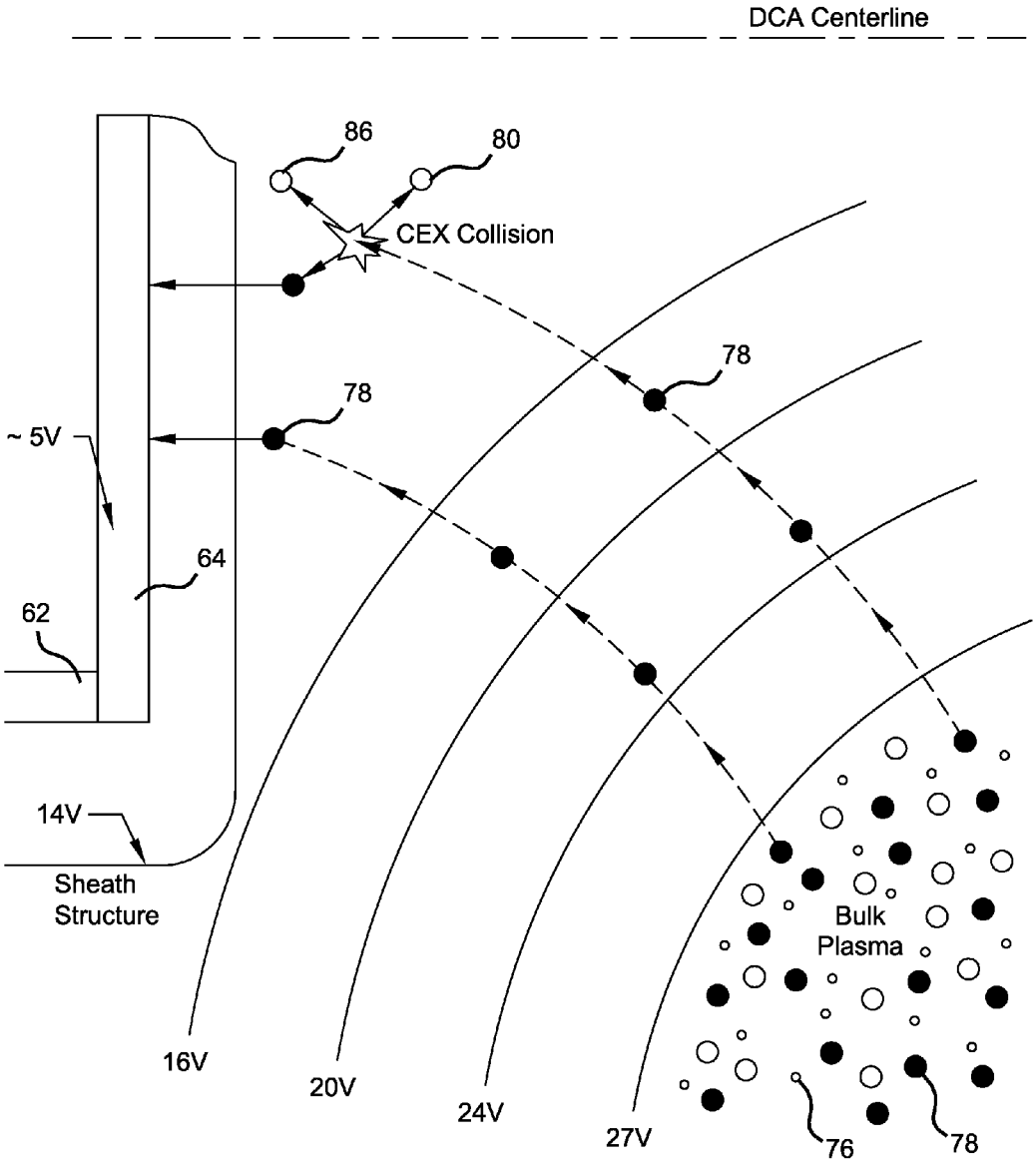
FIG. 6 is a schematic illustration of the discharge cathode assembly erosion processes.

The erosion process couples the near-DCA plasma potential structures with charge-exchange (CEX) collisions to explain the known wear test results and erosion profiles. Referring to FIG. 6, the CEX collisions and the mechanisms responsible are illustrated. Two plasmas with different properties are actually present in an ion thruster 20: (1) the cathode plasma contained inside the cathode tube 50 and being expelled through the DCA 70 orifice 66; and (2) the bulk discharge plasma located throughout the ion thruster discharge chamber 24. The region where these two plasmas couple or merge together is called a double-layer. The plasma potential changes through the double-layer structure. As a result, ions 78 are pulled from the bulk plasma and focused into the DCA 70. These bombarding ions 78 will impact and cause erosion unless their energy is reduced through CEX collisions with the neutral xenon atoms 80 being expelled from the DCA 70 orifice 66. The product of a CEX collision is a "slow" CEX-ion 84 and "fast" neutral atom 86. The CEX-ion 84 is easily pulled into the DCA keeper 60 by the local electric field. However, CEX-ions 84 are created at a lower potential than ions 78 originating in the bulk plasma and therefore have lower bombarding energy (10 V vs. 22 V). (Note: Voltages in parenthesis are based on FIG. 6 and are only meant to assist with the explanation.) CEX collisions may occur at higher or lower potential locations, in which case the referenced voltages would change. The neutral xenon atom 86 resulting from the CEX collision may also impact the keeper 60 and cause erosion. However, neutral xenon atom 86 is not accelerated through the plasma potential structure and therefore impacts the keeper 60 with the pre-CEX ion energy (~12 V). Therefore the presence of CEX collisions decreases keeper 60 erosion because a single high-energy bombarding ion 78 from the bulk plasma (~22 V) is substituted with two lower-energy particles, a CEX-ion 84 (~10 V) and a neutral atom 86 (~12 V). Because sputter erosion is highly dependent on bombarding energy, and each of the two resulting particles 84, 86 has lower energy than the initial ion 78, less erosion occurs. In fact, the energy of each of the post-CEX particles may be lower than the threshold energy of the target material, in which case no sputtering erosion occurs.

Figure 7:
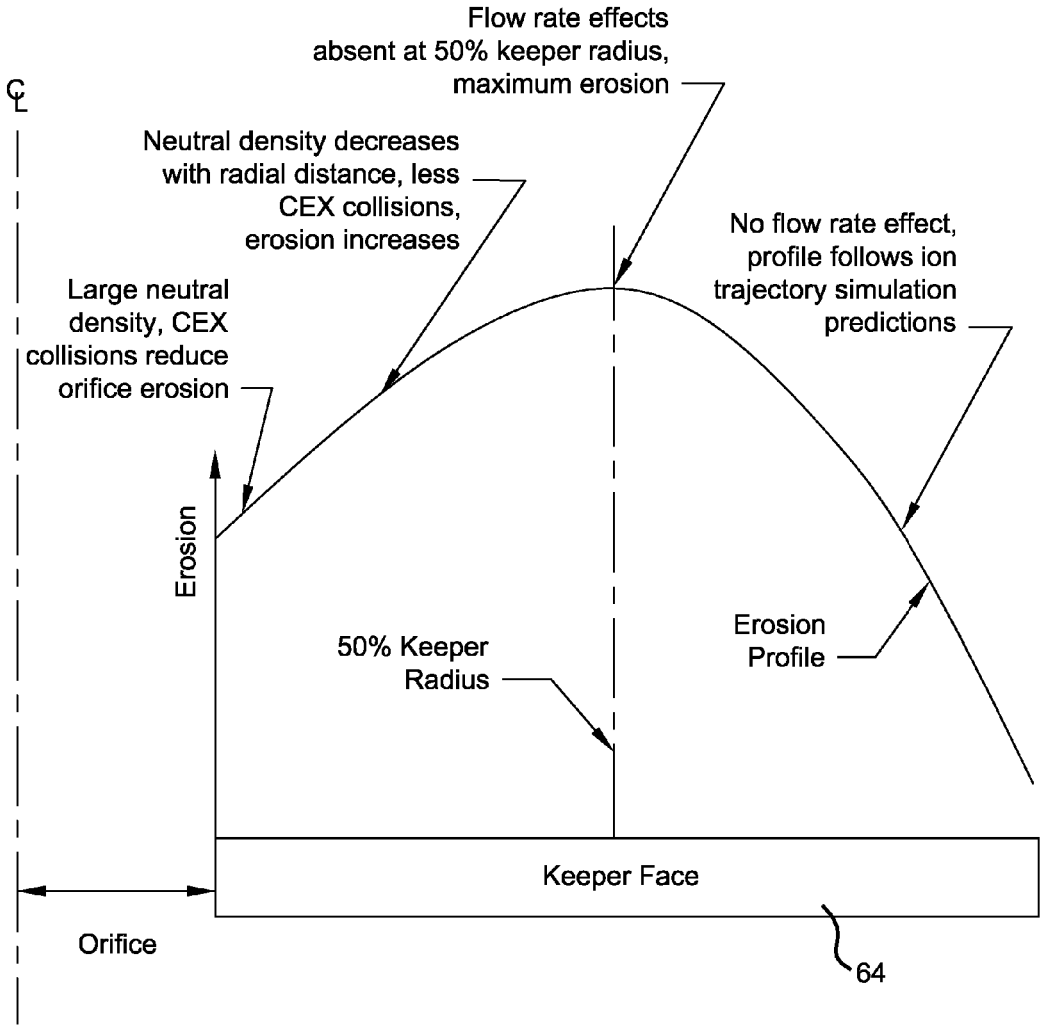
FIG. 7 is a qualitative erosion profile prediction of a keeper faceplate for a high-flow rate condition.
Figure 8:
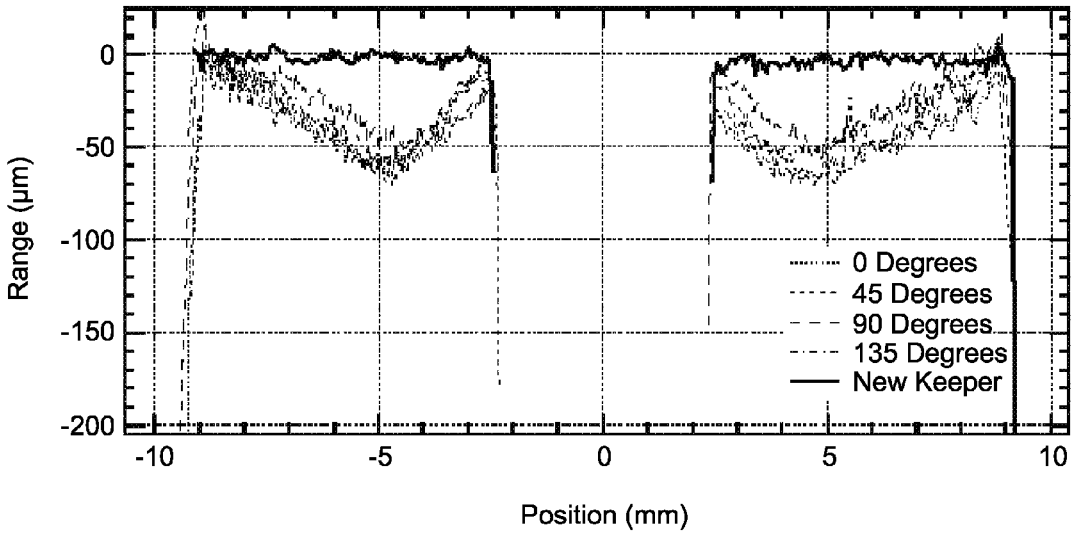
FIG. 8 is a graph of measured profiles of an NSTAR discharge cathode assembly keeper downstream face for a 1,000-hour wear test, conducted primarily at the high-flow rate condition.

The erosion process explains the measured results from the 30-cm NSTAR thruster wear tests and ELT. Specifically, when the NSTAR thruster is operated at the high-power, high-flow rate condition, the erosion profile predicted by the aforementioned process is shown in FIG. 7 (maximum erosion at ~50% keeper radius). FIG. 8 shows the measured erosion profile of the DCA keeper 60 downstream faceplate 64 after the 1,000-hr wear test, which operated primarily at the high-flow rate condition (maximum erosion at ~50% keeper radius).

Because propellant is being expelled from the DCA keeper 60 orifice 66, near the orifice 66, erosion is reduced due to CEX collisions between bombarding ions 78 and expelled propellant. As radial distance from the orifice 66 increases, the neutral density and corresponding number of CEX collisions decreases, leading to an increase in erosion. At approximately the 50% keeper radius, the effects of propellant flow rate from the orifice 66 are no longer present. Therefore, the 50% keeper radius corresponds with the maximum erosion point.

Figure 9:
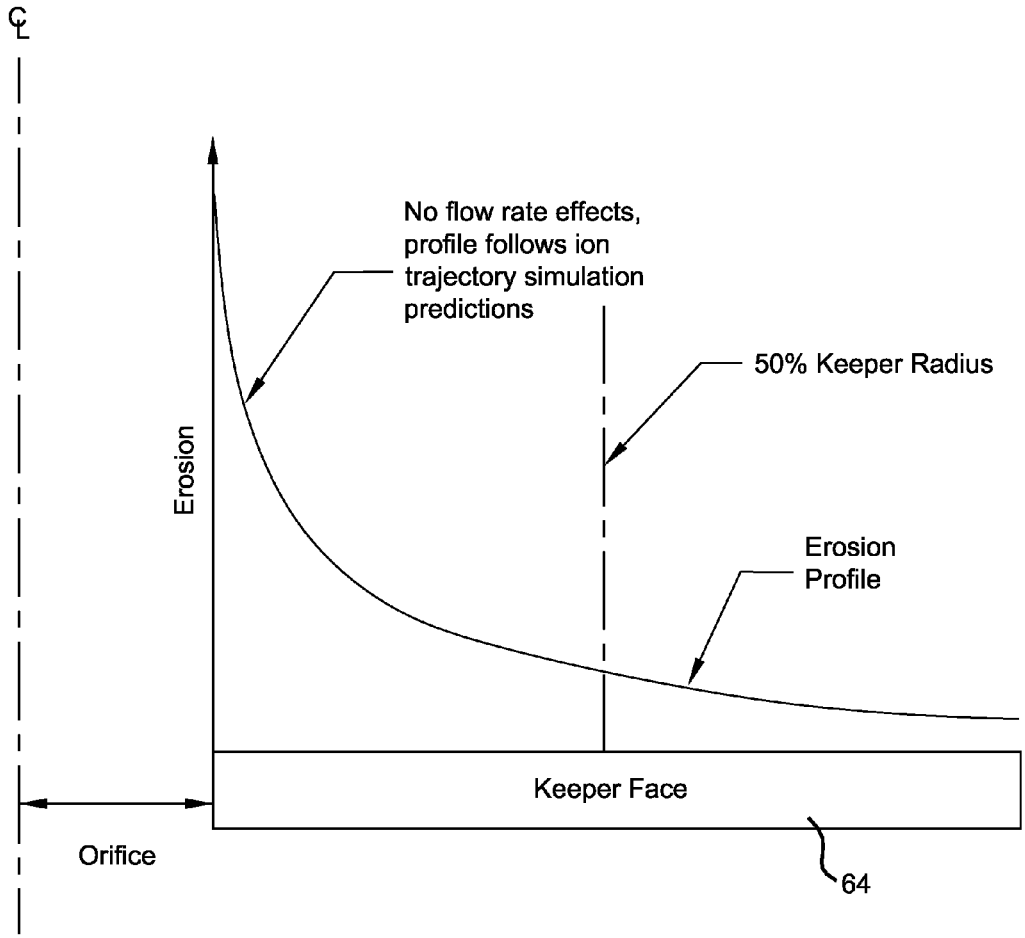
FIG. 9 is a qualitative graph of the erosion profile prediction of a keeper faceplate for a low-flow rate condition.

The low-flow rate condition, as shown in FIG. 9, has a reduction in the flow rate through DCA 70, which reduces the keeper orifice 66 neutral density and therefore the ability of the DCA 70 to protect itself from bombarding ions 78 through CEX collisions. The erosion profile is therefore that shown in FIG. 9 because flow rate effects and CEX collisions are either not present or significantly reduced.

During the ELT, the NSTAR flight spare engine was operated at various power levels and operating points. At the onset of the ELT, the thruster is operated at the high-flow rate condition, where it suffers erosion at the 50% keeper radius point on the keeper downstream faceplate 64 (FIG. 7). At ~4,500-h into the test, the thruster is adjusted to the low-flow rate operating point. The erosion profile then shifts due to the change in DCA flow rate and the erosion now occurs at the keeper orifice 66, leading to a chamfering profile (FIG. 9). At ~10,500 hours, the thruster is returned to high-flow rate, but the keeper orifice 66 has been eroded to two times its initial diameter. Although the DCA flow rate is increased, the keeper orifice 66 is larger so the neutral number density does not return to the original value. Because of the enlarged orifice 66 and corresponding reduced neutral density, the orifice 66 cannot protect itself with CEX collisions and the erosion continues with the FIG. 9 profile even though the thruster is operating at high-flow rate. This erosion profile remains the same throughout the remainder of the ELT, eventually eroding away the entire keeper faceplate 64.

The above results indicate that increasing propellant flow rate through the DCA orifice 66 shields the orifice 66 from bombarding, erosion-causing ions 78. CEX collisions between bombarding ions 78 and expelled neutral atoms 80 reduce the energy of impacting ions 84, thus reducing sputtering erosion. A gas-fed hollow cathode keeper according to the present teachings utilizes this phenomenon to reduce or possibly eliminate erosion of keeper 60.

Figure 10:
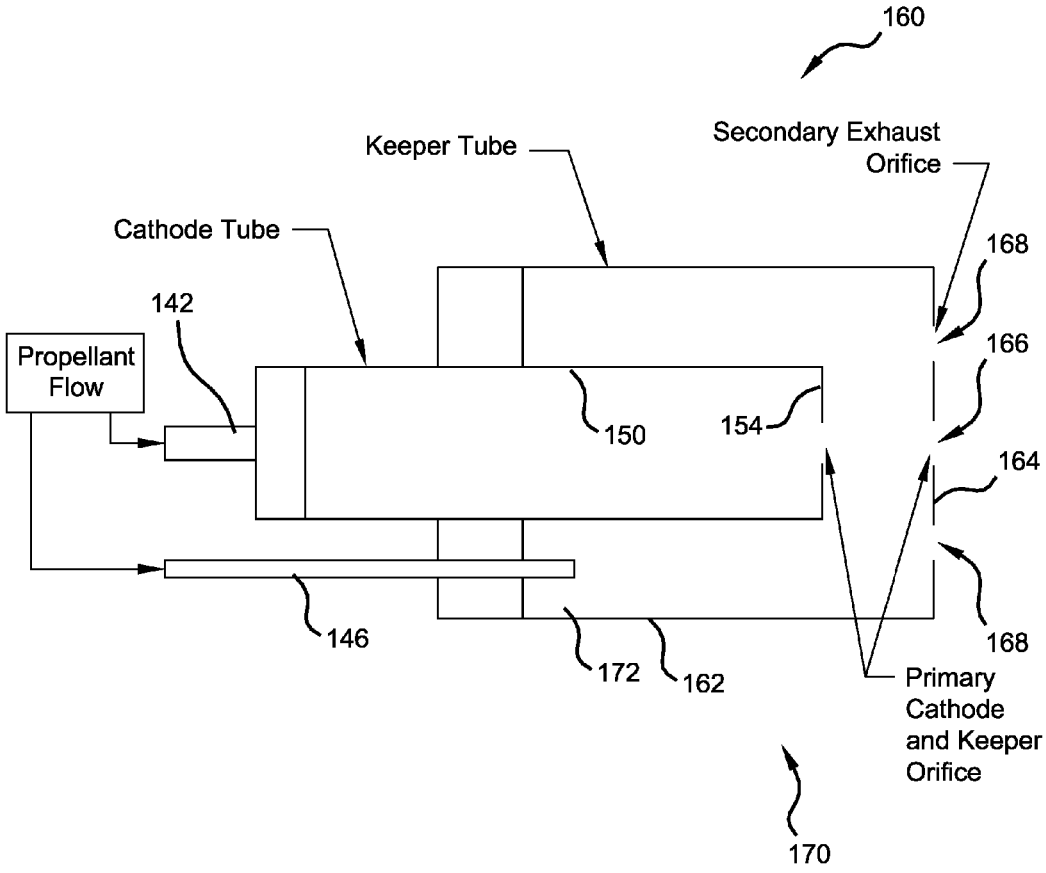
FIG. 10 is a schematic representation of a discharge cathode assembly according to the present teachings.
Figure 11:
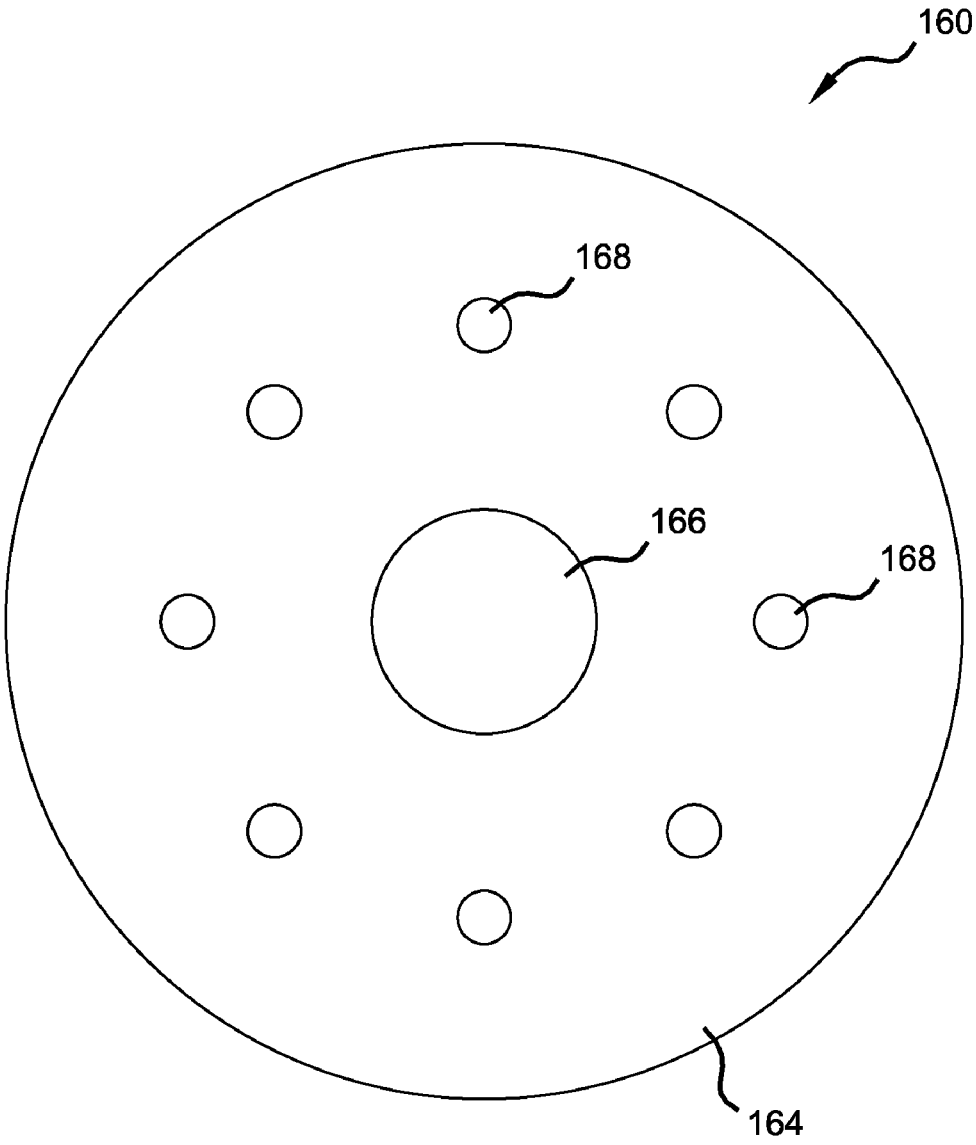
FIG. 11 is a schematic illustration of the keeper faceplate of the discharge cathode assembly of FIG. 10.

Referring now to FIGS. 10 and 11, a schematic representation of a discharge cathode assembly (DCA) 170 according to the present teachings is shown. DCA 170 is similar to DCA 70 discussed above. Thus, only the main differences will be described. In DCA 170, keeper 160 has a faceplate 164 with a primary central orifice 166 and a plurality of secondary orifices 168. DCA 170 includes another propellant feed line 146 that discharges into the space 172 between keeper 160 and cathode tube 150. Propellant feed line 146 can supply propellant to space 172 which can be discharged from keeper 160 through secondary orifices 168 and primary central orifice 166, depending on the flow resistances encountered. Additionally, propellant and electrons discharged through orifice plate 154 of cathode tube 150 also flow out of keeper 160 through primary central orifice 166.

The expulsion of neutral propellant atoms through secondary orifices 168, along with discharge through primary central orifice 166, can create a shield around keeper faceplate 164 so that high-energy bombarding ions 78 suffer CEX collisions with the neutral particles 80. As previously mentioned, CEX collisions replace a high-energy bombarding ion 78 with two lower-energy particles: a CEX-ion 84 and a neutral atom 86. Additionally, the CEX collisions can also randomize the trajectory of the energetic neutral particle 86 to distribute particle flux.

The arrangement of secondary orifices 168 on faceplate 164 can vary. One possible arrangement is shown in FIG. 11, wherein eight secondary orifices 168 are arranged symmetrically around primary central orifice 166 in a circular pattern. It should be appreciated that other arrangements of secondary orifices 168 on faceplate 164 can be implemented to provide a desired shield of neutral atoms in front of faceplate 164.

The dimensions of secondary orifices 168, and the required flow rate therethrough to be effective, can vary depending upon the desired shield to be created in front of faceplate 164. In one example, eight secondary orifices 168 can have a 1-mm diameter, then a 4.0 sccm-XE flow can produce a secondary-orifice neutral number density of $1.6\times10^{21}$ $m^{-3}$, which is identical to the NSTAR DCA keeper orifice for TH15 operation described above.

DCA 170 can provide a shield in front of faceplate 164 without requiring extra propellant flowing to the ion thruster within which it is utilized. The main propellant flow to cathode tube 150 through propellant feed line 142 and to discharge chamber 24 through propellant feed line 40 can be reduced such that the total flow rate through DCA 170 and exiting faceplate 164 through both primary central orifice 166 and secondary orifices 168 is the same as that used in an ion thruster 20 having a DCA 70. The ability to maintain the same flow rate eliminates the need for extra propellant to be carried on the spacecraft utilizing an ion thruster with DCA 170 and, therefore, does not waste propellant and reduce the specific-impulse of such an ion thruster.

Furthermore, a separate flow control system is not required because the keeper propellant through propellant feed line 146 can be leached off of the propellant flow to cathode tube 150. Propellant can be directed from propellant feed line 142 into propellant feed line 146 for supply to space 172. This can be achieved by having propellant feed line 146 having a smaller diameter than propellant feed line 142. The amount of propellant transferred from propellant feed line 142 to propellant feed line 146 can be designed by the relative sizing of feed lines 142, 146. For instance, propellant feed line 146 may be of a smaller diameter than propellant feed line 142 so that only a small fraction of the propellant supplied to DCA 170 is directed to space 172.

Figure 12:
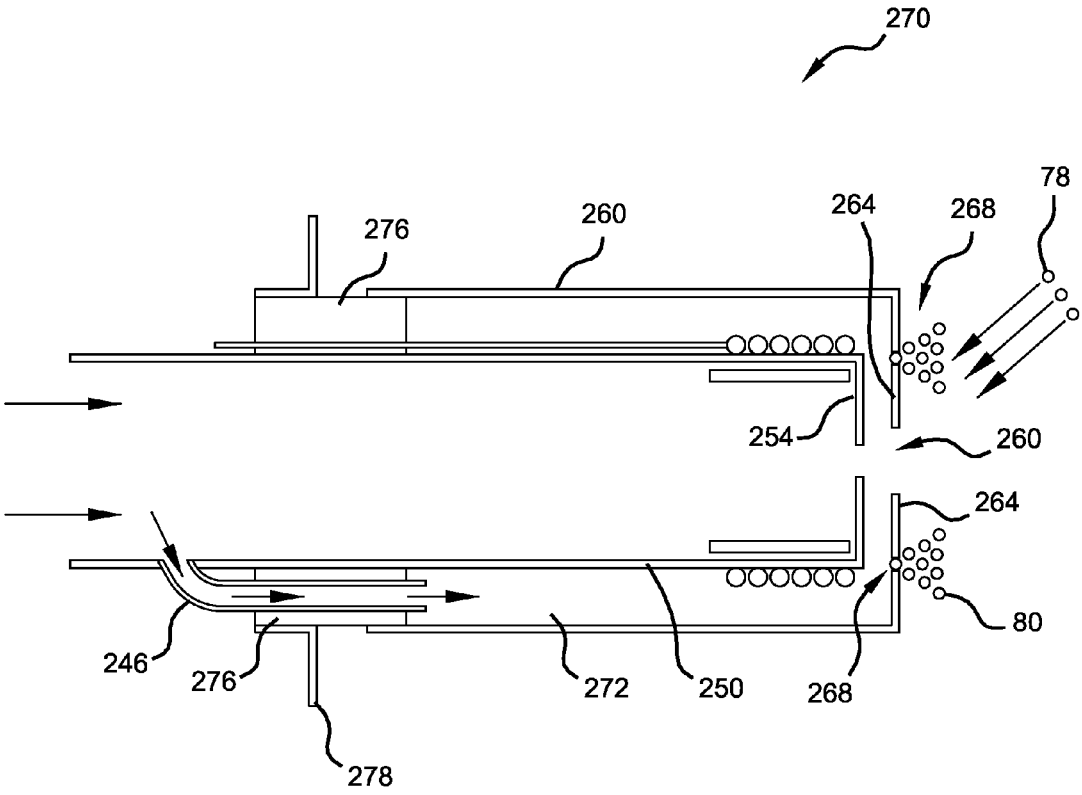
FIG. 12 is a schematic illustration of another discharge cathode assembly according to the present teachings.

Referring now to FIG. 12, another DCA 270 according to the present teachings is schematically illustrated. DCA 270 is similar to DCA 170 discussed above, therefore, only the main differences will be described. In DCA 270, propellant feed line 246 is coupled to cathode tube 250. An isolator 276 extends around cathode tube 250, and propellant feed line 246 passes therethrough. Isolator 276 can electrically isolate cathode tube 250, keeper 260, and propellant feed line 246 from each other and from a mounting plate 278 that supports DCA 270. A fraction of the propellant flowing through cathode tube 250 is directed into propellant feed line 246 and supplied to space 272 for discharge through secondary orifices 268. Propellant feed line 246 can be sized relative to the opening in orifice plate 254 on the end of cathode tube 250 so that a desired ratio of propellant flowing through the opening in orifice plate 254 relative the propellant flowing through space 272 is achieved. With this arrangement, a single flow control device can be utilized to supply all of the propellant flow to DCA 270.

While orifice plates 154, 254 are described as having primary central orifices 166, 266 and secondary orifices 168, 268, it should be appreciated that other configurations can be utilized according to the present teachings. For example, keeper faceplate 164, 264 could be a porous member that allows propellant in space 172, 272 to flow through the porous member along the entirety of the faceplate. For example, the faceplate can be a porous foam that has multiple flow paths therethrough and allows propellant to be expelled over the entire faceplate area. The use of a foam can result in a lower velocity of the propellant exiting the faceplate, thereby resulting in a shield having a lower velocity such that the neutral atoms 80 stay in front of the faceplate for a longer duration of time.

Faceplate 164, 264 can be made from a variety of materials. By way of non-limiting example, faceplate 164, 264 can be made from molybdenum or carbon, such as graphite.

Thus, a DCA according to the present teachings provides a propellant flow through the faceplate of the keeper to provide a shield of neutral propellant atoms. The shield can promote the occurrence of CEX collisions with ions that would otherwise bombard the DCA unimpeded. The CEX collisions can reduce the energy of the atoms that strike the DCA, thereby reducing the occurrence of corrosion and/or eliminating the corrosion. The use of the shield can increase the life of an ion thruster using a DCA according to the present teachings.

Furthermore, the present teachings provide a method of increasing the life of a DCA by promoting CEX collisions in front of the DCA. The CEX collisions can be promoted through the supplying of a shield of neutral propellant atoms in front of the faceplate of the DCA. The neutral atom shield can be provided from a portion of the propellant flow that flows to the cathode tube, thereby providing a same quantity of flow through the DCA and not requiring additional propellant to be utilized. Additionally, by taking a portion of the flow that will be directed through the cathode, the costs and complexity associated with adding an additional flow control device can be avoided.

In addition to use in an ion thruster, the present teachings can be utilized in other plasma applications. For example, many larger ion sources utilize a hollow cathode electron source, and a gas-fed keeper according to the present teachings can also be used to increase the lifetime of these devices. For example, a gas-fed keeper cathode according to the present teachings and the method of using the same could be used in Hall thruster systems, and in non-electric propulsion applications such as improved electron sources for plasma processing, electron-beam diagnostics, and surface characterization.

An erosion-resistant cathode keeper according to the present teachings can also have applications in the semiconductor industry. Many semi-conductor applications require the plasma environment to be virtually free of impurities. Due to the highly sensitive nature of semi-conductor electrical properties to the levels of dopants and impurities, a pristine plasma environment is required for these processes so that impurities do not become deposited. A hollow cathode tube that does not sputter or erode and release impurities into the plasma can be quite useful for maintaining a pristine plasma environment. Thus, such areas may be able to advantageously utilize the methods of inhibiting sputter or erosion of a cathode and/or a cathode keeper according to the present teachings.

While the present teachings have been described with relation to specific examples and applications, it should be appreciated that these are used for exemplary purposes only and that other applications and configurations can be employed. For example, a DCA according to the present teachings can be employed in an ion thruster having multiple cathodes therein. Additionally, the arrangement and configuration of the secondary orifices can vary from that shown. Thus, the examples and illustrations given herein are merely exemplary in nature and are not intended to limit the scope of the present teachings.

Erosion Process

Nomenclature

| | |
|---|---|
| $A =$ | Keeper orifice area ($m^2$) |
| $\vec{B} =$ | Magnetic field (T) |
| $\vec{E} =$ | Electric field (V/m) |
| $E_a =$ | Axial electric field component (V/m) |
| $E_i =$ | Impacting ion energy (eV) |
| $E_r =$ | Radial electric field component (V/m) |
| $\vec{F} =$ | Force (N) |
| $I_d =$ | Discharge current (A) |
| $I_{emag} =$ | Electromagnet current (A) |
| $j =$ | Initial ion current density ($A/m^2$) |
| $j_z =$ | Attenuated ion current density ($A/m^2$) |
| $K_0, K_1, K_2 =$ | Exponential fit coefficients |
| $m_i =$ | Ion mass ($2.18 \times 10^{-25}$ kg) |
| $\dot{m} =$ | Mass flow rate (kg/s) |

-continued

| | |
|---|---|
| $\vec{x} =$ | Spatial location (m) |
| $x_a =$ | Axial location (m) |
| $x_r =$ | Radial location (m) |
| $Y =$ | Sputtering yield (atoms/ion) |
| $\dot{m}_{sccm} =$ | Mass flow rate (sccm) |
| $n_i =$ | Ion number density ($m^{-3}$) |
| $n_n =$ | Neutral number density ($m^{-3}$) |
| $p =$ | Neutral pressure (Pa) |
| $q =$ | Ion charge (Coulombs) |
| $T =$ | Neutral temperature (K) |
| $t =$ | Time (s) |
| $u =$ | Neutral velocity (m/s) |
| $V_d =$ | Discharge voltage (V) |
| $V_p =$ | Plasma potential (V) |
| $\vec{v} =$ | Velocity (m/s) |
| $v_a =$ | Axial velocity component (m/s) |
| $v_i =$ | Average ion velocity (m/s) |
| $v_r =$ | Radial velocity component (m/s) |
| $z =$ | Attenuation path length (m) |
| $\lambda_{CEX} =$ | Charge-exchange mean free path (m) |
| $\sigma_{ce} =$ | CEX collision cross section ($m^2$) |
| $\theta =$ | Impacting ion angle (degrees) |

Acronyms

| | |
|---|---|
| 5PLPF | 5 planar Langmuir probe with propellant flow |
| CEX | Charge-exchange |
| DC | Diagnostic cylinder |
| DCA | Discharge cathode assembly |
| ELT | Extended life test |
| LVTF | Large vacuum test facility |
| MCDC | Multiple-cathode discharge chamber |
| MFP | Mean free path |
| Mo | Molybdenum |
| NSTAR | NASA solar electric propulsion technology and applications readiness |
| PEPL | Plasmadynamics and electric propulsion laboratory |
| PLP | Planar Langmuir probe |
| TA | Test article |

I. Introduction

Ion thrusters are high-specific impulse, high-efficiency advanced space propulsion systems that are being proposed as the primary propulsion source for a variety of ambitious, long-term, deep space missions. Specifically, missions will require thruster operational lifetimes on the order of 7-14 years. Contemporary ion thruster technology utilizing molybdenum discharge cathode keepers is incapable of providing these extended lifetimes due to discharge cathode erosion, which limits the operational life to approximately 3-5 years.

Erosion of the NASA Solar Electric Propulsion Technology and Applications Readiness (NSTAR) discharge cathode has been noted in three wear tests performed on a 30-cm engine and an extended life test (ELT) on the flight spare Deep Space One ion engine. During the first wear test, erosion of the discharge cathode was noted, and the engineering solution was to utilize a sacrificial keeper maintained at an intermediate potential between the discharge cathode and anode. The subsequent 1000-h and 8200-h wear tests showed erosion of the discharge cathode assembly (DCA) keeper occurring primarily from the downstream keeper face at approximately the 50% keeper radius, as shown in FIG. 8. However, during the ELT, the primary erosion location changed from the keeper downstream face to the keeper orifice. Experimental investigations have found that the erosion location shifted when the thruster was operated at a reduced beam current condition; i.e., when the thruster was adjusted from the nominal high-power TH15 condition to the lower-power TH8 operating point. Nominal operating conditions for the NSTAR thruster are shown in Table 1. Note the reduction in DCA flow from TH15 to TH8.

TABLE 1

Selected NSTAR ion thruster nominal operating parameters

| Operating Point | Input Power[a] (kW) | Beam Current[b] (A) | Beam Voltage[b] (V) | Accelerator Voltage (V) | Main Flow (mg/s) | Discharge Cathode Flow (mg/s) |
|---|---|---|---|---|---|---|
| TH0[c] | 0.5 | 0.51 | 650 | −150 | 0.58 | 0.24 |
| TH4[c] | 1.0 | 0.71 | 1100 | −150 | 0.81 | 0.24 |
| TH8[c] | 1.4 | 1.10 | 1100 | −180 | 1.40 | 0.24 |
| TH10[c] | 1.7 | 1.30 | 1100 | −180 | 1.67 | 0.25 |
| TH12[c] | 1.8 | 1.49 | 1100 | −180 | 1.79 | 0.26 |
| TH15[c] | 2.3 | 1.76 | 1100 | −180 | 2.27 | 0.36 |

[a]Nominal values.
[b]Power supply current or voltage.
[c]Nominal NSTAR operating The following sections describe an ion thruster DCA erosion process based on near-DCA NSTAR plasma potential measurements and experimental results for propellant flow rate effects on ion number density. An ion trajectory analysis algorithm based on the NSTAR plasma potential structure for TH8 and TH15 is developed to determine the bombarding ion location and angle at the DCA keeper. A diagnostic cylinder (DC) is designed and operated inside a multiple-cathode discharge chamber (MCDC) to determine the effect of propellant flow rate on "keeper" orifice number density. Finally, the results from these two analyses are combined to define a DCA erosion process that qualitatively explains the erosion patterns in the wear-test and ELT results.

II. Erosion Profile Simulation

Erosion profile simulations are completed to determine how the near-DCA plasma potential structures are contributing to the known DCA erosion. Specifically the trajectories of ions in the discharge chamber are computed utilizing simple force equations and experimental plasma potential maps. The following sections describe the two main components of the erosion profile simulator and the simulation results. The erosion profile simulator is divided into two parts: (1) calculation of the ion trajectory to determine bombarding ion impact angle and location on the keeper downstream face; and (2) an erosion calculation (i.e., how many atoms are sputtered per incident ion) using the calculated impact angle and known bombarding ion energy. Combining these two steps allows a simulated keeper erosion profile to be determined.

A. Ion Trajectory Calculation

An ion trajectory calculation compiled using MatLab is utilized to determine the bombarding ion impact angle and location at the keeper downstream face. The trajectory simulation procedure is divided into five main steps: (1) load the plasma potential maps; (2) calculate the electric field produced by the variation of plasma potential with spatial location; (3) determine initial conditions for a simulation ion; (4) iteratively calculate the ion trajectory based on the initial conditions; and (5) determine if the ion impacts the keeper and, if so, determine the impact location and angle.

Figure 13:
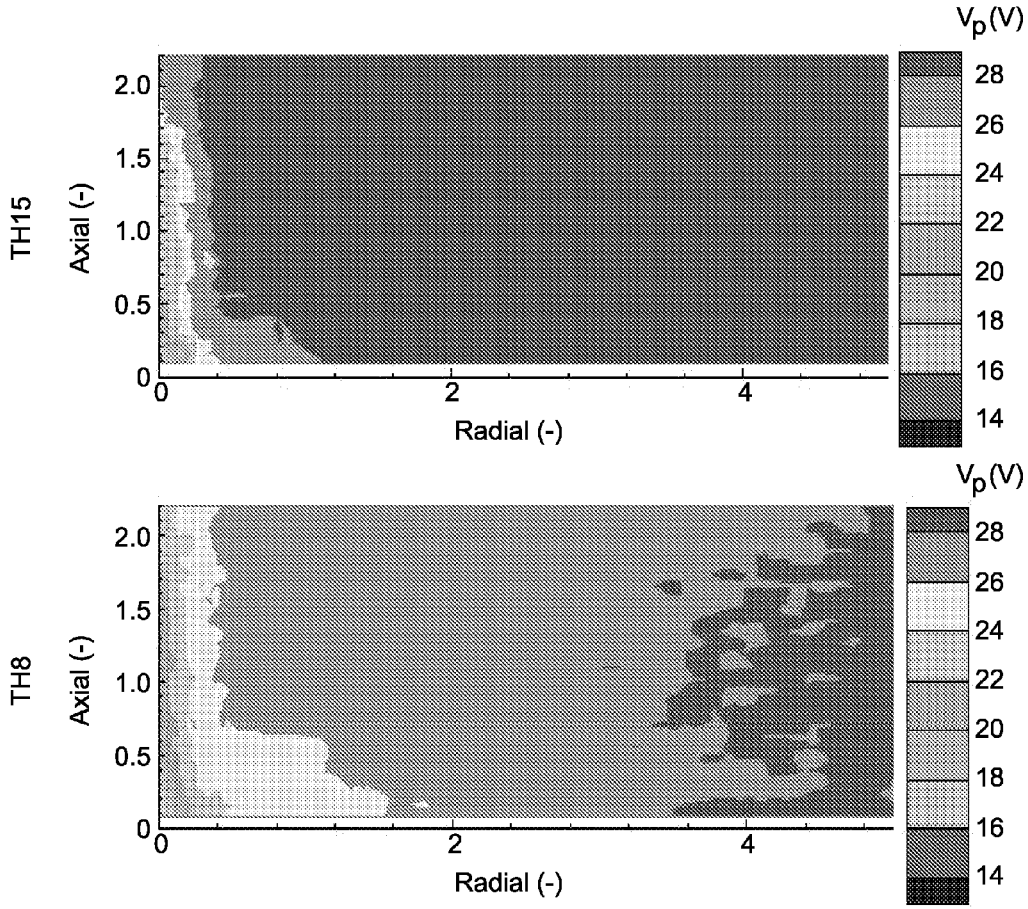
FIG. 13 is a graph showing experimental measured plasma potential profiles in the near-DCA region of an NSTAR ion thruster for TH15 and TH8 operations.
Figure 14:
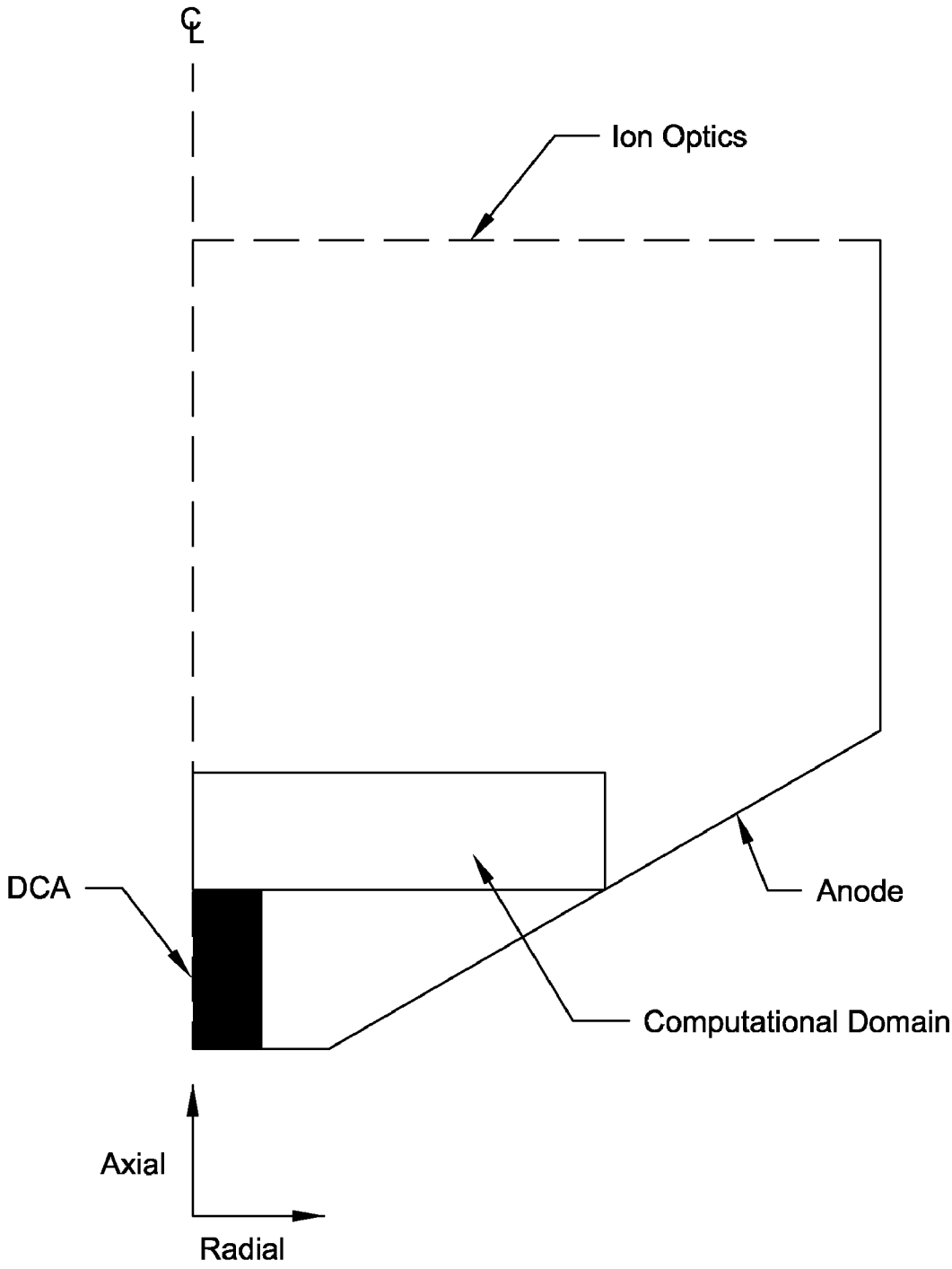
FIG. 14 is a schematic of an ion thruster showing the computational domain over which ion trajectories are computed.
Figure 15:
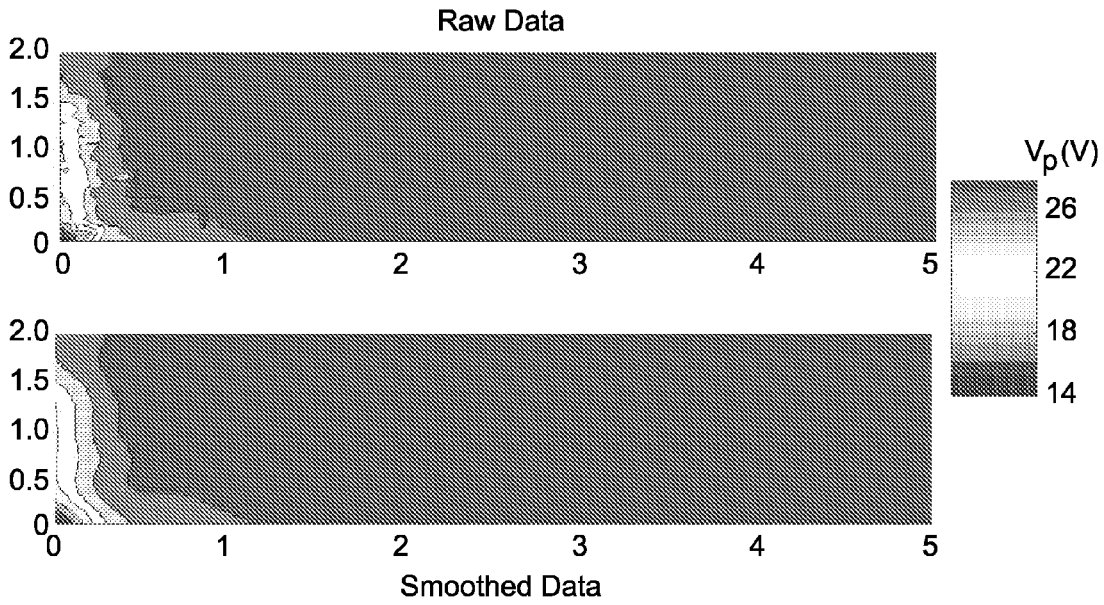
FIG. 15 is a comparison of raw and smoothed data for TH15 operation.

Initially the near-DCA plasma potential structures are loaded. The plasma potential structures associated with TH15 and TH8 are shown in FIG. 13. The 2-D area over which the data are plotted is initially reduced to create a rectangular region shown in FIG. 14. This domain size is chosen because plasma potential data are only available in this region and computationally the analysis is simplified for a rectangular domain. Next the data are interpolated onto a 1 mm by 1 mm grid such that the entire computational domain has 4400 grid points. Because a certain amount of noise is present in the raw plasma potential data, the built-in MatLab cubic smoothing spline algorithm is used to smooth the data. An example of the raw and smoothed data is shown in FIG. 15. Next the electric field is calculated within the computational domain. The electric field at a given point is determined using the plasma potentials at the six adjacent points and Eq. 1, where $V_p$ is plasma potential, $\vec{E}$ is electric field, and $\vec{x}$ is the relative position between grid points.

$$\vec{E} = -\frac{dV_p}{d\vec{x}} \tag{1}$$

Table 2 shows the ion initial conditions investigated. A single simulation has 35,200 ions with 4400 initial positions (an ion starts from each of the computational domain grid points) and 8 initial angular orientations. Angular orientations of 0 degrees and 90 degrees correspond to an initial velocity in the positive radial and positive axial directions, respectively. Simulations are completed for both warm and cold ions, as well as singly- and doubly-charged ions. Warm and cold ions are assumed to have energies of 5 eV and 0.05 eV, respectively.

TABLE 2

Ion initial conditions

| | |
|---|---|
| Locations | 4400 points (Δx = 1.0 mm) |
| Charge-state | singly, doubly |
| Initial Energy (eV) (velocity) | Warm (5 eV)<br>Cold (0.05 eV) |
| Anglular Orientation (deg.) | 0, 45, 90, 135, 180, 225, 270, 315 |

Utilizing the provided initial conditions, the ion trajectory is calculated by iterating through the familiar Lorentz force equation, Eq. 2.

$$\vec{F}=q(\vec{E}+\vec{v}\times\vec{B}) \tag{2}$$

In this equation, $\vec{F}$ is the force on the ion, $\vec{E}$ is the electric field, $\vec{v}$ is the ion velocity, q is the ion charge, and B is the magnetic field. For the simulations presented here, the magnetic field inside the ion thruster is assumed to have a negligible impact on ion motion and therefore the Lorentz equation can be reduced and divided into axial and radial components as shown in Eq. 3, where Newton's relation for force and acceleration has also been used.

$$\left(\frac{dv}{dt}\right)_a = \frac{qE_a}{m_i} \qquad \left(\frac{dv}{dt}\right)_r = \frac{qE_r}{m_i} \tag{3}$$

In these equations, $v_a$ and $v_r$ are the ion velocity in the axial and radial directions, respectively, t is time, q is the ion charge, $E_a$ and $E_r$ are the axial and radial electric field, respectively, and $m_i$ is the ion mass. Lastly, Eq. 4 is utilized as the relation between spatial location and velocity, where $x_a$ and $x_r$ are the axial and radial position, respectively.

$$v_a = \left(\frac{dx}{dt}\right)_a \qquad (4)$$

$$v_r = \left(\frac{dx}{dt}\right)_r$$

Utilizing the equations described above, the trajectory calculation iterative procedure loop is as follows: (1) interpolate the electric field at the ion position (because the ion position is rarely directly on one of the grid points, the electric field values are linearly interpolated from the 4 nearest grid points); (2) calculate the new velocity components using Eq. 3; (3) determine the new spatial location by assuming the new velocity components are constant over the time step; and (4) repeat. This procedure loop is iterated until the ion exits the computational domain (FIG. 14). If the ion exit position is at the DCA keeper, then the ion impact location is recorded and the bombarding angle is calculated by fitting a line to previous locations along the trajectory. The inverse tangent of the inverse of the slope of this line provides the impact angle with respect to keeper normal (Note: these are the pre-sheath angle and pre-sheath location). The outputs of the trajectory simulator are the initial location, initial velocity components, pre-sheath impact angle, pre-sheath velocity components, and pre-sheath impact location of ions striking the keeper.

Figure 16:
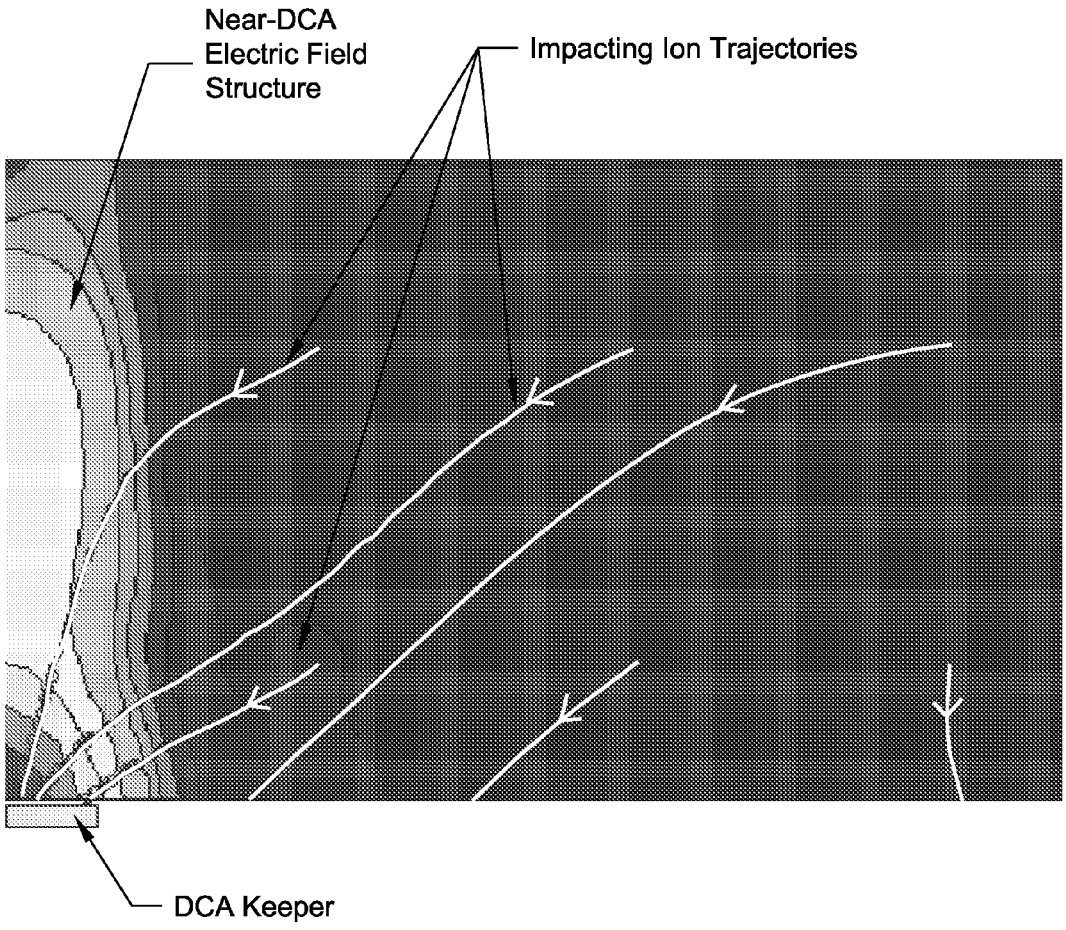
FIG. 16 is an example of ion trajectories through the calculated electric field profile within the computational domain.

Initial simulations are completed to determine the required time step that provides accurate and timely results. Simulations are completed for values greater than or equal to $1\times10^{-9}$ s. Comparison of the output results show that time steps of $1\times10^{-7}$ s and smaller yield identical trajectories. Therefore a time step of $1\times10^{-7}$ s is used for all simulations reported here. Examples of ion trajectories through the calculated electric field profile are shown in FIG. 16. Note that three of the six ions impact the keeper.

B. Erosion Calculation

The results of the trajectory simulations provide the pre-sheath impact angle, pre-sheath velocity components, and pre-sheath impact location of ions striking the DCA keeper. However, ions first pass through the keeper sheath before impacting, so the through-sheath impact location, angle, and energy must be determined. An ion is assumed to only translate axially through the sheath, so the through-sheath impact location is equivalent to the pre-sheath location. This assumption is justified by the small thickness of the sheath and small radial electric fields expected within the sheath. Pre-sheath radial velocity is assumed constant through the sheath and the axial velocity component is assumed to increase corresponding with the gain in energy through the keeper sheath potential drop. The angle of the sum of these two velocity components is the through-sheath impact angle. The near-DCA plasma potential (~14 V) and floating keeper potential (~5 V) are used to determine the keeper sheath potential drop of ~9 V. Bombarding ion energy is calculated as the ion kinetic energy using the through-sheath velocity components.

The keeper erosion profile is found utilizing the through-sheath impact angle, location, and velocity components. Calculation of an erosion profile requires either an accurate sputtering yield model or, in this case, experimental sputtering yield data. Sputtering yield, Y, is a statistical variable defined as the mean number of atoms removed from a solid target per incident particle. In this application, the sputtering yield indicates the mean number of molybdenum (Mo) atoms removed from the keeper face per incident xenon ion.

Mo sputtering yields have been measured during xenon ion bombardment in the energy range of 10 to 200 eV utilizing the standard weight loss and spectroscopic techniques. These results compare nicely to each other and to existing low-energy $Xe^+$—Mo data taken by other researchers. These experimental data are the low-energy normal-incidence sputtering yields that are utilized as the basis for the erosion calculations. The measured data are log-log plotted and a sixth order polynomial fit to the resulting graph provides an empirical relation for sputtering yield (Y) and normal-incident bombarding ion energy ($E_i$), Eq. 5.

$$Y_{Doener}(E_i) = \exp\{-0.372304[\ln(E_i)]^6 + 9.48041[\ln(E_i)]^5 - 100.046[\ln(E_i)]^4 + 560.276[\ln(E_i)]^3 - 1758.24[\ln(E_i)]^2 + 2940.48[\ln(E_i)] - 20646.3\} \qquad (5)$$

$$\left(\frac{Y(\theta)}{Y(0)}\right) = \cos^{-19.96}(\theta)\cdot\exp[-13.55(\cos^{-1}(\theta)-1)] \qquad (6)$$

An empirical formula for the angular dependence of the sputtering is given as Eq. 6. The numeric factors are energy-dependent fit parameters determined from 100 eV xenon ions impacting a Mo target and Y(0) is the sputtering yield at normal incidence, i.e., Eq. 5. Previous use of this erosion analysis algorithm has been applied with success.

C. Simulation Results

Figure 17A:
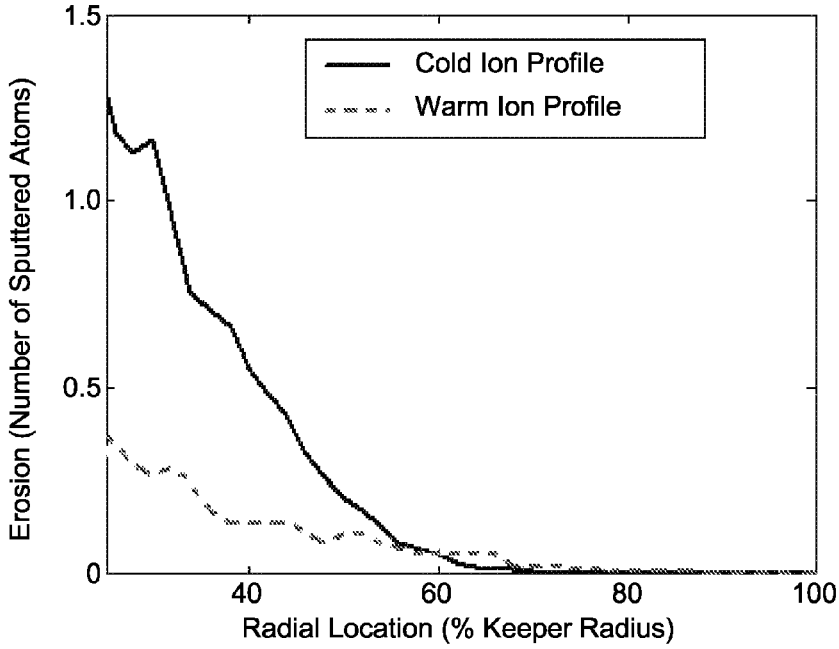
FIGS. 17A and 17B are graphs of simulated erosion profiles for warm and cathode assumptions for TH15 and TH8 NSTAR plasma potential maps, respectively.
Figure 17B:
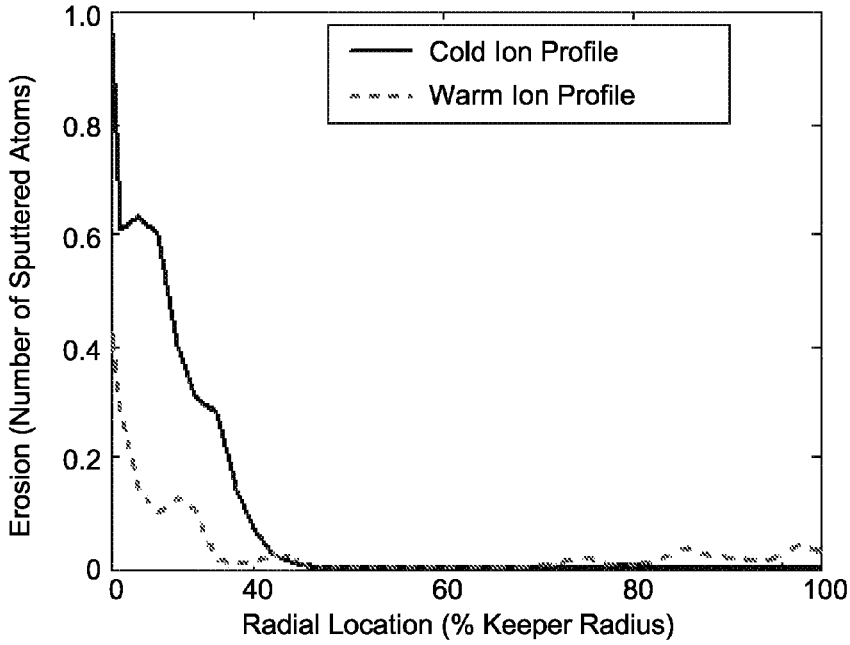

Simulation results are for singly- and doubly-charge ions, as well as cold and warm ion populations. FIGS. 17A and 17B show simulated erosion profiles for the warm and cold ion assumptions for the TH15 and TH8 NSTAR thruster operating conditions. The doubles-to-singles ratio in the NSTAR thruster is a function of the operating condition and is expected to be within 20-25%. For this analysis the ratio is assumed to be a constant equal to 20%, so each erosion profile shown is the sum of 80% of the singly-charged profile and 20% of the doubly-charged profile. Doubly-charged ions tend to increase the magnitude of the profile, but have no affect on the shape. The warm ion assumption predicts less erosion of the keeper than the cold profile because higher-energy, warm ions are capable of escaping from the near-DCA low plasma potential region, while less-energetic, cold ions are more easily pulled into the keeper by the potential field. Because the discharge chamber plasma contains a distribution of ions, the true erosion profile is assumed to be some combination of the warm and cold ion results.

Both the TH15 and TH8 results predict an erosion profile that leads to chamfering of the keeper orifice. The increase in erosion at the keeper orifice (~25% keeper radius) leads to a chamfering profile that causes the orifice diameter to increase until the entire keeper face is eroded. This analysis indicates that the plasma potential structure produced by the coupling of the DCA with the bulk plasma causes the primary erosion location to be at the DCA keeper orifice. Results from the 1,000-h and 8,200-h wear-tests show the dominant erosion location to be at approximately the 50% keeper radius location (FIG. 8), not the keeper orifice. Therefore the plasma potential structure alone can not be causing the known erosion results.

III. Propellant Flow Rate Effects

A MCDC test article (TA) is used to predict the effects of propellant flow rate on near-DCA plasma properties. The TA is a rectangular discharge chamber designed to increase thruster life by operating three sequential DCAs. Therefore, at any time, the TA contains an active DCA and two dormant cathodes. For the experiment presented here an active NEXT-DCA and two DCs are attached to the TA. Each DC appears similar in size and shape to the active DCA, but is outfitted with plasma diagnostics to analyze the dormant cathode plasma properties. Specifically, each DC is outfitted with 5 planar Langmuir probes (PLP) and is capable of propellant flow (5PLPF). These devices allow the effects of propellant flow on dormant cathode plasma properties to be studied. During data acquisition, as the DC propellant flow is increased the main plenum flow rate is decreased such that the total propellant flow rate is constant. This also ensures that the TA performance properties are maintained. The Plasmadynamics and Electric Propulsion Laboratory (PEPL) Large Vacuum Test Facility (LVTF) at the University of Michigan is used for all experiments.

A. 5PLPF-DC

Figure 18:
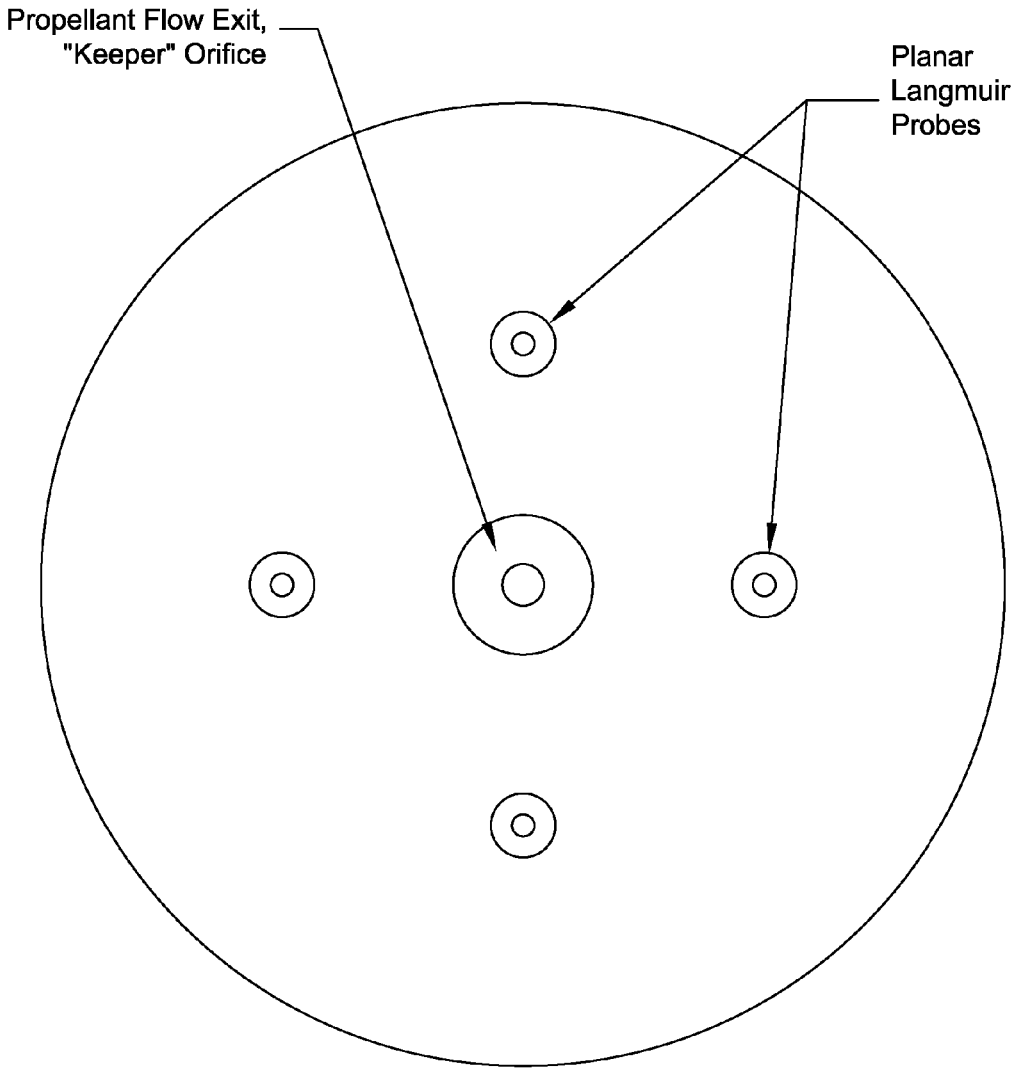
FIG. 18 is a plan view of a 5PLPF-DC.
Figure 19:
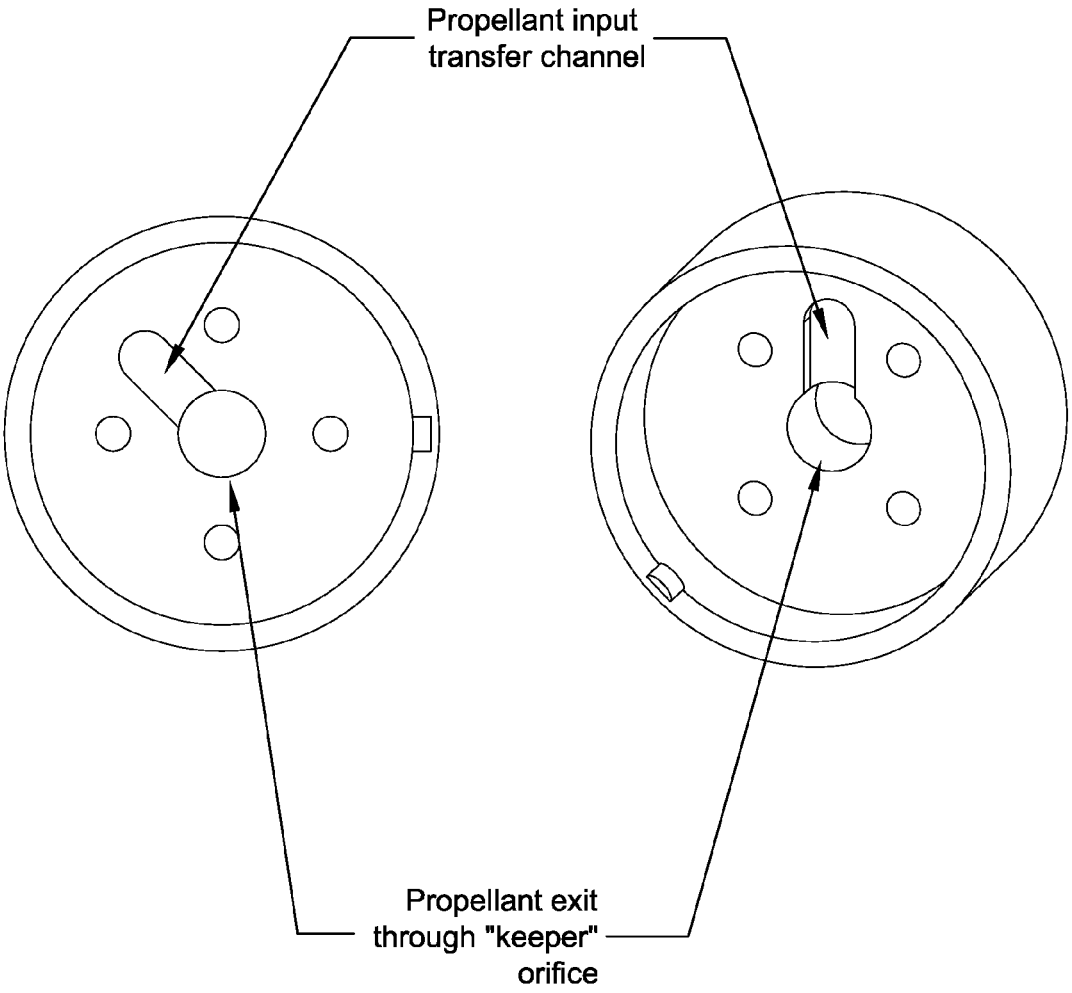
FIG. 19 is an internal schematic of a 5PLPF-DC.

Two 5PLPF-DCs are fabricated to make plasma property measurements at the two dormant cathode locations internal to the TA. Each DC appears similar to the active NEXT-DCA, however, each DC "keeper" is outfitted with 5 PLPs at different spatial locations as shown in FIG. 18. A stainless steel "keeper" is attached to a Macor insulator to form the base of the DC. The 5PLPF-DCs do not contain a "cathode" electrode. Ten PLPs are constructed of 0.08 cm (0.031") diameter tungsten wire surrounded by a 0.16 cm (0.063") outer diameter alumina tube yielding a probe area of 0.50 $mm^2$. Each PLP is inserted axially into the DC such that the probe collecting surface is flush with the "keeper" faceplate. Five (5) PLPs are placed into each of the two DCs in a symmetrical pattern with each probe spaced 0.64 cm (0.25") from the centerline axis. Ceramic epoxy is utilized to construct the probes, as well as to mate the probes, "keeper", and Macor insulator. An aluminum mounting flange is utilized to attach the DC to the TA at one of the dormant cathode locations. Finally, a 3.2 mm (0.125") outer diameter tube is inserted off-centerline into the DC to feed propellant through the "keeper" orifice. A small internal channel is used to transfer the off-axis propellant tube exhaust to the "keeper" orifice. A schematic of this setup is shown in FIG. 19.

B. Results

Data are obtained for a variety of TA operational configurations and the configuration nomenclature is shown in the Appendix. The 5PLPF-DC trends due to adjustment of the magnetic field, DCA location, and DC connectivity are consistent with previous investigations. Of primary interest for the discussion presented here is the effect of DC propellant flow on ion number density at the DC "keeper" orifice and downstream face. Results obtained with the probe located in the "keeper" orifice are discussed first.

Figure 20A:
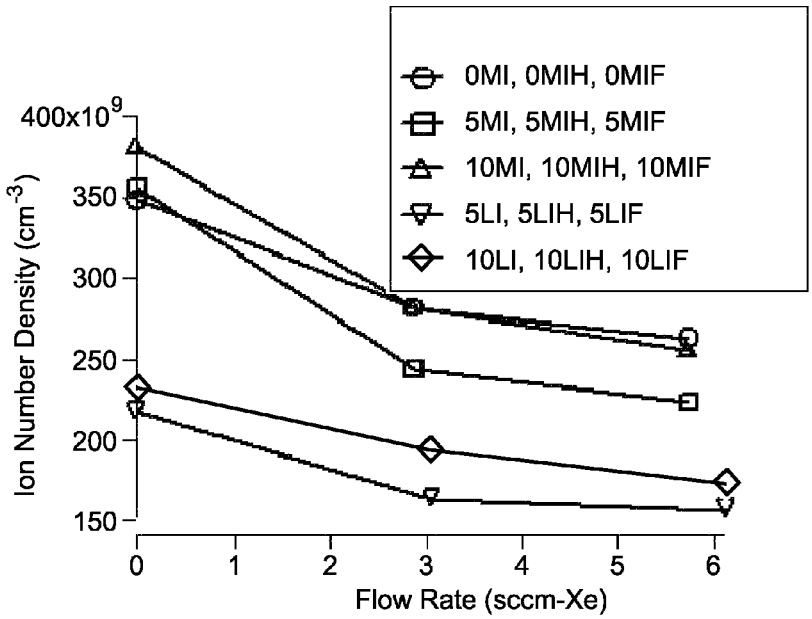
FIGS. 20A and 20B are graphs of the 5PLPF results for a keeper orifice probe for the configurations shown and probes with different locations on the right DC for 0MI, 0MIH, and 0MIFTA configurations, respectively.

Results reported in FIG. 20A are for probe 14, which is located at the "keeper" orifice of the DC on the right side of the TA for all experiments. Results indicate that the number density at the DC orifice decreases approximately 20% when the DC propellant flow is adjusted from zero to the full DCA flow rate. The number density results are of particular interest because the flow appears to be shielding the DC from bombarding ions, a result consistent with a previous investigation. Therefore TA dormant cathodes should be operated with propellant flow in order to reduce the number of ions bombarding those units and causing pre-operation erosion. Perhaps the pre-operation wear of the dormant cathodes can be reduced by as much as 20% by operating the units with propellant flow.

Figure 20B:
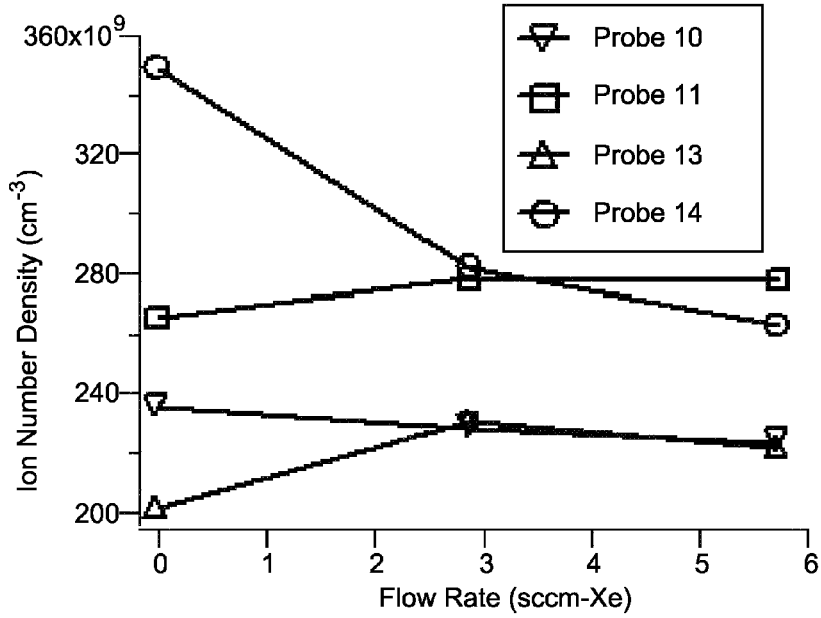

Results from the probes located at different locations on the DC "keeper" face plate (probe 10, 11, and 13) do not show the same trend in ion number density as the "keeper" orifice probe (probe 14). These results are shown in FIG. 20B. Because the results with the other probes do not show a consistent trend and the ion number density does not increase or decrease as significantly as the "keeper" orifice probe, the effects of the propellant flow are assumed to become negligible at the radial location of these probes. Therefore, at ~50% "keeper" radius from the DC centerline propellant flow no longer has a noticeable effect on the measured number density.

Figure 21:
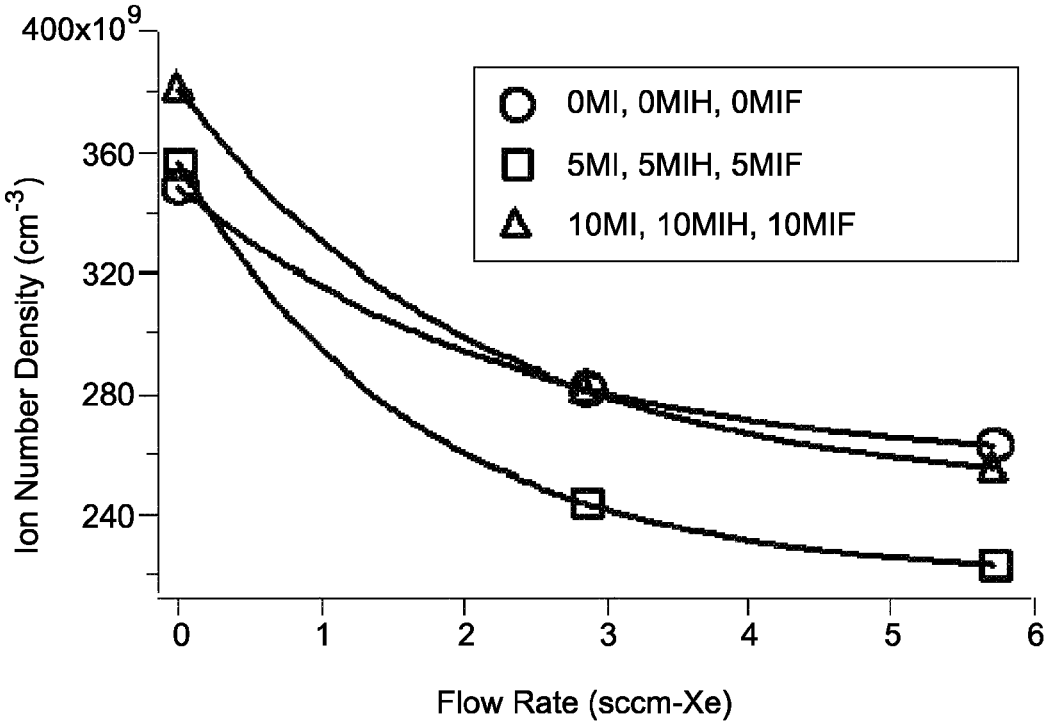
FIG. 21 is graph of exponential fits to the keeper orifice probe data for various TA configurations.

The decrease in DC "keeper" orifice number density may be attributed to elastic and charge-exchange (CEX) collisions, where the latter is known to cause changes in near-DCA ion energy distributions when external flow is present. Elastic collisions may also be present, but have a significantly smaller collision cross-section and are not included in this analysis. Considering the "keeper" orifice bombarding ions as an ion beam with initial current density, j, a first order estimation of the attenuation due to CEX collisions is obtained by considering the ion continuity equation in one dimension. The ratio of the ion current density at some position, $j_z$, to the initial ion current density is obtained by integrating over the pathlength, z. The result is Eq. 7, $$\frac{j_z}{j} = \exp(-n_n \sigma_{ce} z) \tag{7}$$

where $j_z$ is the ion current density after the beam has suffered CEX attenuation over a pathlength z, j is the ion current density measured if CEX collisions are not present, $n_n$ is the neutral density, and $\sigma_{ce}$ is the CEX collision cross-section. Ion current density is related to ion number density through Eq. 8, $$j = q n_i v_i \tag{8}$$

where j is ion current density, q is the charge of the ions, $n_i$ is the ion number density, and $v_i$ is ion velocity. Assuming the mass flow rate through the DC, $\dot{m}_{sccm}$, is proportional to the neutral density, $n_n$, the experimental data in FIG. 20A can be fit using a slightly modified form of Eq. 7. The form of the equation fit to the data is shown in Eq. 9, $$n_i = K_0 + K_1 \exp(-K_2 \dot{m}_{sccm}) \tag{9}$$

where $n_i$ is ion number density, $K_0$, $K_1$, and $K_2$ are the fit coefficients, and $\dot{m}_{sccm}$ is the flow rate in sccm. The fit coefficients for the three curves shown in FIG. 21 are given in Table 3. These fits strongly suggest that CEX collisions are causing the observed trends. However, in order for this analysis to be appropriate the pathlength, z, should be greater than the mean free path (MFP) of a CEX collision. This ensures that multiple CEX collisions are occurring over the integrated pathlength.

TABLE 3

Exponential fit parameters and ratio of the pathlength to the CEX mean free path

| Configuration | $K_o$ | $K_1$ | $K_2$ | $z/\lambda_{CEX}$ $\dot{m}_{sccm}$ = 3 | $z/\lambda_{CEX}$ $\dot{m}_{sccm}$ = 6 |
|---|---|---|---|---|---|
| 0MI, 0MIH, 0MIF | 2.56E+11 | 9.33E+10 | 0.442 | 1.87 | 3.75 |
| 5MI, 5MIH, 5MIF | 2.19E+11 | 1.37E+11 | 0.597 | 2.53 | 5.07 |
| 10MI, 10MIH, 10MIF | 2.46E+11 | 1.35E+11 | 0.471 | 2.00 | 4.00 |

The relationship for the CEX MFP is given in Eq. 10, $$\lambda_{CEX} = \frac{1}{\sqrt{2}\, n_n \sigma_{ce}} \tag{10}$$

where $\lambda_{CEX}$ is the CEX MFP, $\sigma_{ce}$ is the CEX collision cross-section, and $n_n$ is the neutral density. By setting the exponential of Eq. 7 and Eq. 9 equal, a relationship between the theoretical attenuation equation and the experimental data can be determined. This result is shown in Eq. 11.

$$n_n \sigma_{ce} z = K_2 \dot{m}_{sccm} \tag{11}$$

$$\frac{z}{\lambda_{CEX}} = \sqrt{2}\, K_2 \dot{m}_{sccm} \tag{12}$$

Combining Eq. 10 and Eq. 11 allows the ratio of the pathlength to the CEX MFP to be determined. The result is shown as Eq. 12. For the flow rates presented here (~3 and 6 sccm) and for the experimentally determined $K_2$ values, the ratio is typically between 2-5, and the results for the data in FIG. 21 are shown in Table 3. These results show that the pathlength is larger than the CEX MFP, indicating that CEX collisions are responsible for the observed decrease in ion number density with increasing propellant flow rate.

An estimation of the neutral pressure at the DC "keeper" orifice is obtained by considering the continuity equation and the ideal gas law. The result is Eq. 13, $$p = \frac{\dot{m}RT}{uA} \tag{13}$$

where p is neutral pressure, u is the neutral velocity at the orifice, A is the orifice area, T is the neutral temperature, $\dot{m}$ is the mass flow rate, and R is the specific gas constant for xenon. Assuming T is 1000 K[28] and the velocity is equal to the sound speed, the pressure is calculated to be ~60 mTorr for the maximum flow rate, which yields a neutral density of $5.5\times 10^{20}\ m^{-3}$. Furthermore, if the bombarding ions are assumed to have energy equal to the plasma potential (~30 V), $\sigma_{ce}$ is equal to 45 Å[2 29] and the CEX MFP and corresponding pathlength, z, are calculated to be 2.9 mm and 14 mm, respectively.

IV. DCA Erosion Process

The DCA erosion process combines the plasma potential profile ion trajectory simulations and the DC propellant flow rate effects. The following sections use the results presented above to qualitatively predict erosion profiles for the TH15 and TH8 operating conditions, as well as to explain the change in erosion profile between operating points. The process is then used to explain the ELT erosion results.

One of the key assumptions is that the propellant flow rate results obtained with the 5PLPF-DCs are applicable to the active DCA. The 5PLPF-DCs are not electron emitting devices and are therefore not producing the familiar near-DCA plasma potential structures. The active DCA keeper may have a different ion number density distribution.

A. TH15

The NSTAR operating condition TH15 is the high-power, high-flow rate condition (Table 1). FIG. 7 shows the predicted erosion profile for TH15 and FIG. 8 shows the measured erosion profile of the DCA keeper downstream face after the 1,000-h wear test, which operated primarily at TH15. Propellant flow rate results with the DCs indicate that near the DCA keeper orifice, bombarding ion number density is reduced due to CEX collisions. Therefore the erosion at the keeper orifice predicted by the ion trajectory simulation is reduced. As radial distance from the orifice increases, the neutral density and corresponding number of CEX collisions decreases, leading to an increase in erosion. At approximately the 50% keeper radius, the DC results indicate that the effects of propellant flow rate are no longer present. Therefore the 50% keeper radius corresponds to the maximum erosion point. Note that in the 1,000 hour wear test results (FIG. 8) the maximum erosion occurs at approximately the 50% keeper radius. At larger radial locations the erosion profile corresponds to the ion trajectory simulation results because propellant flow rate effects are no longer present.

B. TH8

The TH8 NSTAR operating point is lower-power and lower-flow rate than the TH15 point. The reduction in DCA flow rate reduces the keeper orifice neutral density and therefore the ability of the DCA to protect itself from bombarding ions through CEX collisions. The TH8 erosion profile is therefore identical to the ion trajectory simulation predicted profiles because flow rate effects and CEX collisions are either not present or significantly reduced. This result is shown in FIG. 9.

C. ELT Results Explanation

During the ELT, the NSTAR flight spare engine was operated at various power levels and operating points. Erosion of the DCA keeper orifice began during TH8 after ~6,400-h of operation. The sudden and significant increase in keeper orifice erosion also corresponded with a short between the cathode and the keeper. It has been shown that the potential structure of the near-DCA plasma does not change when the cathode is shorted to the keeper. However, bombarding ions gain more energy through the keeper sheath (the keeper-to-cathode floating potential, 3-7 V) when the cathode is shorted to the keeper, which increases the sputter yield and the erosion rate. The following section uses the DCA erosion process to explain the ELT results.

At the onset of the ELT, the thruster is operated at TH12 and then TH15, where it suffers erosion at the 50% keeper radius point on the keeper downstream face (TH15 erosion profile, FIG. 7). At ~4,500-h into the test, the thruster is adjusted to the lower-power, lower-flow rate TH8 operating point. The erosion profile then shifts due to the change in DCA flow rate and the erosion now occurs at the keeper orifice, leading to a chamfering profile (FIG. 9). The cathode-to-keeper short at ~6,400-h only increases the erosion rate, however, the erosion profile is not affected. At ~10,500 hours the thruster is returned to TH15, but the keeper orifice has been eroded to two times its initial diameter. Although the DCA flow rate is increased upon returning to TH15, the keeper orifice is larger so the neutral number density does not return to the pre-TH8 value. Because of the enlarged orifice and corresponding reduced neutral density, the erosion continues with the TH8 profile even though the thruster is operating at TH15. This erosion profile remains the same throughout the remainder of the ELT, eventually eroding away the entire keeper face.

V. Conclusion

A DCA erosion process is based on ion trajectory simulation results and propellant flow rate effects. Ion trajectories are simulated using the plasma potential structure measurements and simple force equations. Results indicate that the plasma potential structures cause a chamfering erosion of the DCA keeper orifice, which eventually causes the orifice to enlarge and the keeper face to be completely eroded. These results are identical for the TH15 and TH8 operating conditions, indicating that the potential structure alone can not be causing the 1,000-h wear-test erosion results. Propellant flow rate effects on a DC in a MCDC TA indicate that increasing flow rate through the DCA may lead to a decrease in orifice bombarding ions due to CEX collisions. The erosion process combines these two effects to predict erosion profiles for the NSTAR TH15 and TH8 operating conditions. The process indicates that the lower power, lower flow rate TH8 condition has a linear erosion profile that causes more erosion at the keeper orifice. This profile leads to chamfering of the orifice and eventual loss of the keeper face. The high-power, high flow rate TH15 has a peaked erosion profile with a maximum occurring at approximately the 50% keeper radius point. The process is consistent with erosion profiles measured after the 1,000 hour wear test and indicate the erosion profile changes from TH15 to TH8.

The process indicates that the ELT erosion results are a product of the thruster operating point and the cathode-to-keeper short. Specifically the change in ELT erosion location from the downstream keeper face to the keeper orifice was caused by the decrease in propellant flow rate when the thruster was adjusted from TH15 to TH8 and the increase in erosion rate was caused by the keeper short to the cathode. It may be possible to mitigate keeper orifice erosion by increasing the DCA flow rate when operating at the TH8 condition.

What is claimed is:

1. A gas-fed hollow cathode keeper comprising:

a keeper faceplate;

a primary keeper orifice formed in said keeper faceplate and through which electrons and a gas flow from a cathode can flow; and at least one secondary gas flow path through said keeper faceplate, said at least one secondary gas flow path allowing a gas containing neutral atoms to flow through said keeper faceplate at a flow rate sufficient to create a shield of neutral atoms around at least a portion of said keeper faceplate such that at least some bombarding ions suffer charge exchange (CEX) collisions.

2. The gas-fed hollow cathode keeper according to claim 1, wherein said keeper faceplate is porous foam and said at least one secondary flow path is one of a plurality of flow paths through said porous foam.

3. The gas-fed hollow cathode keeper according to claim 1, wherein said at least one secondary flow path through said keeper faceplate is one of a plurality of secondary exhaust orifices.

4. The gas-fed hollow cathode keeper according to claim 3, wherein said secondary exhaust orifices are disposed in a circular orientation about said primary keeper orifice.

TABLE 4

MCDC TA operational configurations
Appendix

| Configuration | DCA | $I_d$ (A) | $V_d$ (V) | Mass Flow, DCA (sccm) | Mass Flow, Anode (sccm) | $I_{emag}$ (A) | DC Electrical Connectivity | DC Flow Rate |
|---|---|---|---|---|---|---|---|---|
| 0LI | Left | 30 | 24.5 | 6.12 | 30.9 | 0 | Isolated | No Flow |
| 0MI | Center | 30 | 24.4 | 5.73 | 30.9 | 0 | Isolated | No Flow |
| 5LI | Left | 30 | 25.8 | 6.12 | 30.9 | 5 | Isolated | No Flow |
| 5MI | Center | 30 | 25.5 | 5.73 | 30.9 | 5 | Isolated | No Flow |
| 10LI | Left | 30 | 28.2 | 6.12 | 30.9 | 10 | Isolated | No Flow |
| 10MI | Center | 30 | 27.3 | 5.73 | 30.9 | 10 | Isolated | No Flow |
| 0LIH | Left | 30 | 24.5 | 6.12 | 30.9 | 0 | Isolated | Half DCA |
| 0MIH | Center | 30 | 24.4 | 5.73 | 30.9 | 0 | Isolated | Half DCA |
| 5LIH | Left | 30 | 25.8 | 6.12 | 30.9 | 5 | Isolated | Half DCA |
| 5MIH | Center | 30 | 25.5 | 5.73 | 30.9 | 5 | Isolated | Half DCA |
| 10LIH | Left | 30 | 28.2 | 6.12 | 30.9 | 10 | Isolated | Half DCA |
| 10MIH | Center | 30 | 27.3 | 5.73 | 30.9 | 10 | Isolated | Half DCA |
| 0LIF | Left | 30 | 24.5 | 6.12 | 30.9 | 0 | Isolated | Full DCA |
| 0MIF | Center | 30 | 24.4 | 5.73 | 30.9 | 0 | Isolated | Full DCA |
| 5LIF | Left | 30 | 25.8 | 6.12 | 30.9 | 5 | Isolated | Full DCA |
| 5MIF | Center | 30 | 25.5 | 5.73 | 30.9 | 5 | Isolated | Full DCA |
| 10LIF | Left | 30 | 28.2 | 6.12 | 30.9 | 10 | Isolated | Full DCA |
| 10MIF | Center | 30 | 27.3 | 5.73 | 30.9 | 10 | Isolated | Full DCA |

5. The gas-fed hollow cathode keeper according to claim 1, further comprising a keeper tube coupled with said keeper faceplate thereby defining a volume within which a cathode tube can be disposed.

6. The gas-fed hollow cathode keeper according to claim 5, wherein said volume directs a gas flowing therethrough into said at least one secondary gas flow path through said keeper faceplate.

7. The gas-fed hollow cathode keeper according to claim 5, further comprising a cathode tube disposed within said volume, said cathode tube outputting a flow including neutral gas atoms and electrons.

8. The gas-fed hollow cathode keeper according to claim 1, wherein propellant gas flows through said at least one secondary gas flow path.

9. A discharge cathode assembly comprising:

a keeper tube having a volume therein;

a faceplate on an end portion of said keeper tube, said faceplate having a primary orifice therethrough and at least one secondary flow path extending therethrough, said primary orifice and said at least one secondary flow path allowing gas to flow through said faceplate in at least two different locations; and a cathode tube having an orifice through which electrons and gas are discharged, said cathode tube disposed in said volume with said cathode tube orifice aligned with said keeper faceplate primary orifice and with a space between said cathode tube and an interior wall of said keeper tube, said space forming a flow path between said cathode tube and said keeper tube through which a gas can flow into said faceplate and flow through said at least one secondary flow path.

10. The discharge cathode assembly according to claim 9, wherein said at least one secondary flow path is one of a plurality of secondary orifices spaced about said keeper faceplate.

11. The discharge cathode assembly according to claim 10, wherein said secondary orifices are symmetrically spaced about said keeper faceplate.

12. The discharge cathode assembly according to claim 9, wherein said keeper faceplate is porous foam and said at least one secondary flow path is one of a plurality of secondary flow paths through said porous foam.

13. The discharge cathode assembly according to claim 9, further comprising:

a first propellant flow path communicating with said cathode tube and supplying a propellant thereto; and a second propellant flow path communicating with said space and supplying propellant thereto.

14. The discharge cathode assembly according to claim 13, wherein said second propellant flow path communicates with an interior of said cathode tube and propellant flowing through said second propellant flow path originates from said interior of said cathode tube.

15. A method of inhibiting erosion of a discharge cathode assembly due to ion bombardment comprising:

providing a first flow through a primary orifice of a cathode keeper faceplate, said first flow including electrons and neutral gas atoms;

providing a second flow through said cathode keeper faceplate, said second flow including neutral gas atoms; and creating a shield of neutral gas atoms in front of said faceplate with said first and second flows thereby promoting charge exchange (CEX) collisions between said shield of neutral gas atoms and ions traveling toward the discharge cathode assembly.

16. The method of claim 15, wherein providing a first flow includes flowing propellant through a cathode tube within said cathode keeper and providing a second flow includes flowing propellant through a space between said cathode tube and said cathode keeper.

17. The method of claim 16, wherein providing said second flow includes directing a portion of said first flow flowing through said cathode tube into said space between said cathode tube and said cathode keeper.

18. The method of claim 15, wherein providing a second flow through said faceplate includes flowing said second flow through a plurality of secondary orifices in said faceplate.

19. The method of claim 18, wherein flowing said second flow includes flowing said second flow through a plurality of secondary orifices in said faceplate that are spaced about said primary orifice.

20. The method of claim 15, wherein providing a second flow through said faceplate includes flowing said second flow through a porous foam faceplate.

* * * * *